US012391897B2

(12) United States Patent
Sunahara et al.

(10) Patent No.: US 12,391,897 B2
(45) Date of Patent: Aug. 19, 2025

(54) LUBRICATING OIL COMPOSITION

(71) Applicant: IDEMITSU KOSAN CO., LTD., Chiyoda-ku (JP)

(72) Inventors: Kenji Sunahara, Tsukuba (JP); Shoichiro Fujita, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/788,656

(22) PCT Filed: Dec. 24, 2020

(86) PCT No.: PCT/JP2020/048567

§ 371 (c)(1),
(2) Date: Jun. 23, 2022

(87) PCT Pub. No.: WO2021/132518

PCT Pub. Date: Jul. 1, 2021

(65) Prior Publication Data

US 2023/0051184 A1 Feb. 16, 2023

(30) Foreign Application Priority Data

Dec. 27, 2019 (JP) ..... 2019-239443

(51) Int. Cl.

| | |
|---|---|
| ***C10M 135/18*** | (2006.01) |
| ***C10M 125/22*** | (2006.01) |
| ***C10M 129/52*** | (2006.01) |
| ***C10M 129/54*** | (2006.01) |
| ***C10M 133/06*** | (2006.01) |
| ***C10M 137/10*** | (2006.01) |
| ***C10M 169/04*** | (2006.01) |
| *C10N 10/04* | (2006.01) |
| *C10N 10/12* | (2006.01) |
| *C10N 30/00* | (2006.01) |
| *C10N 30/02* | (2006.01) |
| *C10N 30/04* | (2006.01) |
| *C10N 40/25* | (2006.01) |

(52) U.S. Cl.

CPC ..... *C10M 135/18* (2013.01); *C10M 125/22* (2013.01); *C10M 129/52* (2013.01); *C10M 129/54* (2013.01); *C10M 133/06* (2013.01); *C10M 137/10* (2013.01); *C10M 169/04* (2013.01); *C10M 2201/084* (2013.01); *C10M 2207/142* (2013.01); *C10M 2207/144* (2013.01); *C10M 2215/04* (2013.01); *C10M 2219/068* (2013.01); *C10M 2223/045* (2013.01); *C10N 2010/04* (2013.01); *C10N 2010/12* (2013.01); *C10N 2030/02* (2013.01); *C10N 2030/04* (2013.01); *C10N 2030/52* (2020.05); *C10N 2030/54* (2020.05); *C10N 2040/255* (2020.05)

(58) Field of Classification Search

CPC ..... C10M 135/18; C10M 125/22; C10M 129/52; C10M 129/54; C10M 133/06; C10M 137/10; C10M 169/04; C10M 2201/084; C10M 2207/142; C10M 2207/144; C10M 2215/04; C10M 2219/068; C10M 2223/045; C10M 163/00; C10M 2201/062; C10M 2203/1025; C10M 2207/046; C10M 2207/262; C10M 2207/289; C10M 2215/042; C10M 141/12; C10N 2010/04; C10N 2010/12; C10N 2030/02; C10N 2030/04; C10N 2030/52; C10N 2030/54; C10N 2040/255; C10N 2030/06

See application file for complete search history.

(56) References Cited

U.S. PATENT DOCUMENTS

| | | | | |
|---|---|---|---|---|
| 5,658,862 | A * | 8/1997 | Vrahopoulou | C10M 133/56 508/591 |
| 5,858,931 | A | 1/1999 | Tanaka et al. | |
| 2009/0082233 | A1 | 3/2009 | Kasai | |
| 2016/0130521 | A1 | 5/2016 | Lerasle et al. | |
| 2016/0264901 | A1 | 9/2016 | Iovine et al. | |
| 2017/0121626 | A1 | 5/2017 | Nakaya et al. | |
| 2017/0130158 | A1 | 5/2017 | Tamura | |
| 2017/0158982 | A1 | 6/2017 | Tamura et al. | |
| 2018/0334636 | A1 | 11/2018 | Hoshino et al. | |
| 2018/0355274 | A1* | 12/2018 | Koyama | C10M 169/04 |
| 2019/0024009 | A1 | 1/2019 | Kusumoto et al. | |

(Continued)

FOREIGN PATENT DOCUMENTS

| | | |
|---|---|---|
| CN | 106459819 A | 2/2017 |
| CN | 106967479 A | 7/2017 |

(Continued)

OTHER PUBLICATIONS

Combined Chinese Office Action and Search Report issued Feb. 18, 2023 in Chinese Patent Application No. 202080089919.6 (with unedited computer-generated English Translation), 26 pages.

(Continued)

*Primary Examiner* — Cephia D Toomer
(74) *Attorney, Agent, or Firm* — Oblon, McClelland, Maier & Neustadt, L.L.P.

(57) ABSTRACT

A lubricating oil composition, containing a base oil (A), a metal-based detergent (B), and a molybdenum compound (D), the lubricating oil composition having a content of molybdenum atoms derived from the molybdenum compound (D) of 0.05% by mass or more, a base number of 4.0 mg KOH/g or more, and an HTHS viscosity at 150° C. of 1.3 mPa·s or more and less than 2.3 mPa·s.

20 Claims, No Drawings

(56) References Cited

U.S. PATENT DOCUMENTS

| | | | |
|---|---|---|---|
| 2019/0100713 | A1 | 4/2019 | Utaka et al. |
| 2020/0080018 | A1 | 3/2020 | Matsuda et al. |
| 2020/0181524 | A1 | 6/2020 | Matsuda et al. |
| 2020/0308503 | A1 | 10/2020 | Sunahara et al. |
| 2022/0162516 | A1 | 5/2022 | Fujita |

FOREIGN PATENT DOCUMENTS

| | | | | |
|---|---|---|---|---|
| CN | 108473905 | A | | 8/2018 |
| CN | 108699473 | A | | 10/2018 |
| CN | 108848672 | A | | 11/2018 |
| DE | 10 2020 203 761 | A1 | | 10/2020 |
| EP | 3 578 624 | A1 | | 12/2019 |
| EP | 3 950 905 | A1 | | 2/2022 |
| JP | 2005041998 | | * | 2/2005 |
| JP | 2008066501 | | * | 11/2008 |
| JP | 2015-10177 | A | | 1/2015 |
| JP | 2017-149830 | A | | 8/2017 |
| JP | 2020-164688 | A | | 10/2020 |
| WO | WO 2017/099052 | A1 | | 6/2017 |
| WO | WO 2017/164384 | A1 | | 9/2017 |
| WO | WO 2018/212339 | A1 | | 11/2018 |
| WO | WO 2018/212340 | A1 | | 11/2018 |
| WO | WO 2020/203524 | A1 | | 10/2020 |

OTHER PUBLICATIONS

International Search Report issued Mar. 9, 2021 in PCT/JP2020/048567 filed on Dec. 24, 2020, 3 pages.

Partial European Search Report and Written Opinion issued Dec. 11, 2023 in European Patent Application No. 20906228.0, 13 pages.

Extended European Search Report issued Apr. 19, 2024 in European Patent Application No. 20906228.0, 17 pages.

Office Action issued Jul. 9, 2024, in corresponding Japanese Patent Application No. 2021-567644 (with Global Dossier Translation), 11 pages total.

Official communication issued on May 28, 2025 in EP application 25164404.3.

* cited by examiner

LUBRICATING OIL COMPOSITION

CROSS-REFERENCE TO RELATED APPLICATIONS

The present application is the national stage of international application PCT/JP2020/048567, filed on Dec. 24, 2020, and claims the benefit of the filing date of Japanese Appl. No. 2019-239443, filed on Dec. 27, 2019.

TECHNICAL FIELD

The present invention relates to a lubricating oil composition.

BACKGROUND ART

Associated with the tightening of environmental regulations, a lubricating oil composition used in internal combustion engines of vehicles, such as automobiles, is demanded to achieve a high fuel consumption efficiency. As one of measures for achieving the demand, methods for reducing the friction coefficient by blending a friction modifier to a lubricating oil composition have been variously investigated.

For example, a method of reducing the friction coefficient by blending a particular molybdenum compound as a friction modifier in a lubricating oil composition has been known (see, for example, PTL 1).

CITATION LIST

Patent Literature

PTL 1: JP 2015-010177 A

SUMMARY OF INVENTION

Technical Problem

In recent years, vehicles equipped with a hybrid system or a start-stop system are being spread. Associated with the spread of vehicles equipped with these systems, the temperature of the engine oil in running tends to decrease, and therefore the lubricating oil composition is also demanded to have a fuel consumption efficiency in a low temperature range. However, a molybdenum compound exerts the effect of reducing the friction coefficient in a range of a relatively high temperature (which may be hereinafter referred simply to as a "high temperature range"), but is difficult to exert the effect of reducing the friction coefficient in a low temperature range.

In recent years, furthermore, there is an increasing demand of a fuel consumption efficiency due to the environmental regulations and the like. Accordingly, further decrease of the viscosity of the lubricating oil composition is being investigated. However, a lubricating oil composition having a decreased viscosity readily transfers to the boundary lubrication region to cause a problem of wear.

Consequently, it has been difficult to reduce the friction coefficient of the lubricating oil composition in a wide temperature range including a low temperature range while decreasing the viscosity thereof.

Furthermore, the lubricating oil composition is demanded to secure the prescribed initial base number from the standpoint of securing the long drain property.

The present invention has been made in view of these problems, and an object thereof is to provide a lubricating oil composition that can secure the prescribed initial base number while reducing the friction coefficient in a wide temperature range including a low temperature range, and has a decreased viscosity.

Solution to Problem

The present inventors have made earnest investigations for achieving the object and have accomplished the present invention.

The present invention relates to the following items [1] and [2].

[1] A lubricating oil composition used in a gasoline engine, containing
- a base oil (A),
- a metal-based detergent (B) containing a calcium-based detergent (B1) and a magnesium-based detergent (B2), and
- a molybdenum compound (D),
- the molybdenum compound (D) containing one or more kind selected from a molybdenum dithiocarbamate (D1), a molybdenum dithiophosphate (D2), and a dialkylamine molybdate (D3),
- the lubricating oil composition having
- a content of Mo atoms derived from the molybdenum compound (D) of 0.050% by mass or more based on the total amount of the lubricating oil composition,
- a base number measured by a hydrochloric acid method of 4.0 mgKOH/g or more, and
- an HTHS viscosity at 150° C. of 1.3 mPa·s or more and less than 2.3 mPa·s.

[2] A lubricating oil composition used in a gasoline engine, containing
- a base oil (A),
- a metal-based detergent (B) containing a calcium-based detergent (B1) and a magnesium-based detergent (B2),
- an ash-free friction modifier (C) containing one or more kind selected from an amine-based friction modifier (C1) and an ether-based friction modifier (C2), and
- a molybdenum compound (D),
- the lubricating oil composition having
- in the case where the lubricating oil composition contains the amine-based friction modifier (C1), a content of the amine-based friction modifier (C1) of more than 0.05% by mass based on the total amount of the lubricating oil composition,
- a content of Mo atoms derived from the molybdenum compound (D) of 0.05% by mass or more based on the total amount of the lubricating oil composition,
- a base number measured by a hydrochloric acid method of 4.0 mgKOH/g or more, and
- an HTHS viscosity at 150° C. of 1.3 mPa·s or more and less than 2.3 mPa·s.

Advantageous Effects of Invention

According to the present invention, a lubricating oil composition that can secure the prescribed initial base number while reducing the friction coefficient in a wide temperature range including a low temperature range, and has a decreased viscosity can be provided.

DESCRIPTION OF EMBODIMENTS

In the description herein, the lower limit values and the upper limit values described in a stepwise manner for the preferred numerical ranges (such as the range of the content or the like) each may be independently combined. For example, from the description "preferably 10 to 90, and more preferably 30 to 60", a range of "10 to 60" may be derived from the "preferred lower limit value (10)" and the "more preferred upper limit value (60)".

In the description herein, the numerical values in the examples can be used as the upper limit value and the lower limit value.

In the description herein, the "HTHS viscosity" means the "high temperature high shear viscosity".

In the description herein, the "kinetic viscosity at 100° C." may be referred simply to as a "100° C. kinetic viscosity".

In the description herein, the "high temperature range" means a temperature range where the oil temperature becomes 80° C. or more.

In the description herein, the "low temperature range" means a temperature range where the oil temperature becomes 30° C. to 60° C.

[Embodiment of Lubricating Oil Composition According to First Embodiment]

The lubricating oil composition according to the first embodiment is a lubricating oil composition used in a gasoline engine, containing

- a base oil (A),
- a metal-based detergent (B) containing a calcium-based detergent (B1) and a magnesium-based detergent (B2),
- an ash-free friction modifier (C) containing one or more kind selected from an amine-based friction modifier (C1) and an ether-based friction modifier (C2), and
- a molybdenum compound (D), and
- the lubricating oil composition has
- in the case where the lubricating oil composition contains the amine-based friction modifier (C1), a content of the amine-based friction modifier (C1) of 0.10% by mass or more based on the total amount of the lubricating oil composition,
- a content of Mo atoms derived from the molybdenum compound (D) of 0.05% by mass or more based on the total amount of the lubricating oil composition,
- a base number measured by a hydrochloric acid method of 4.0 mgKOH/g or more, and
- an HTHS viscosity at 150° C. of 1.3 mPa·s or more and less than 2.3 mPa·s.

The lubricating oil composition according to the first embodiment can reduce the friction coefficient in a wide temperature range including a low temperature range while the lubricating oil composition has such a low viscosity as an HTHS viscosity at 150° C. of 1.3 mPa·s or more and less than 2.3 mPa s, by the combination use of the particular metal-based detergents, the use of the particular ash-free friction modifier, the regulation of the molybdenum atom content derived from the molybdenum compound, and the regulation of the base number. The lubricating oil composition can also secure the prescribed initial base number.

In the following description, the "base oil (A)", the "metal-based detergent (B)", the "ash-free friction modifier (C)", and the "molybdenum compound (D)" may be referred to as a "component (A)", a "component (B)", a "component (C)", and a "component (D)", respectively.

The "calcium-based detergent (B1)" and the "magnesium-based detergent (B2)" may be referred to as a "component (B1)" and a "component (B2)", respectively.

The "amine-based friction modifier (C1)" and the "ether-based friction modifier (C2)" may be referred to as a "component (C1)" and a "component (C2)", respectively.

The lubricating oil composition according to the first embodiment may contain an additive for a lubricating oil other than the component (A), the component (B), the component (C), and the component (D), in such a range that does not impair the effects of the present invention.

In the lubricating oil composition according to the first embodiment, the total content of the component (A), the component (B), the component (C), and the component (D) is preferably 80% by mass or more, more preferably 85% by mass or more, and further preferably 90% by mass or more, based on the total amount of the lubricating oil composition.

In the lubricating oil composition according to the first embodiment, the upper limit value of the total content of the component (A), the component (B), the component (C), and the component (D) may be regulated in relation to the content of the additive for a lubricating oil other than the component (A), the component (B), the component (C), and the component (D), and is preferably 97% by mass or less, more preferably 95% by mass or less, and further preferably 93% by mass or less.

The components contained in the lubricating oil composition according to the first embodiment will be described in detail below.

<Base Oil (A)>

The lubricating oil composition according to the first embodiment contains a base oil (A).

The base oil (A) used may be one or more kind selected from mineral oils and synthetic oils that have been used as a base oil of lubricating oils, with no particular limitation.

Examples of the mineral oil include an atmospheric residual oil obtained by subjecting a crude oil, such as a paraffin base crude oil, an intermediate base crude oil, and a naphthene base crude oil, to atmospheric distillation; a distillate oil obtained by subjecting the atmospheric residual oil to distillation under reduced pressure; and a mineral oil obtained by subjecting the distillate oil to one or more refining treatment of solvent deasphalting, solvent extraction, hydro-cracking, solvent dewaxing, catalytic dewaxing, hydrorefining, and the like.

Examples of the synthetic oil include a poly-α-olefin, such as a homopolymer of an α-olefin and an α-olefin copolymer (for example, a copolymer of an α-olefin having 8 to 14 carbon atoms, such as an ethylene-α-olefin copolymer); isoparaffin; an ester, such as a polyol ester and a dibasic acid ester; an ether, such as a polyphenyl ether; a polyalkylene glycol; an alkylbenzene; an alkylnaphthalene; and a GTL base oil obtained through isomerization of wax (gas-to-liquid (GTL) wax) produced from natural gas by a Fischer-Tropsch process or the like.

The base oil (A) is preferably a base oil classified into the Group 2, 3, or 4 in the base oil category of American Petroleum Institute (API).

The base oil (A) may be a mineral oil alone or a combination of plural kinds thereof, and may be a synthetic oil alone or a combination of plural kinds thereof. The base oil (A) may also be a combination of one or more kind of a mineral oil and one or more kind of a synthetic oil.

The 100° C. kinematic viscosity of the base oil (A) is preferably 2.0 $mm^2/s$ to 6.0 $mm^2/s$, more preferably 2.5 $mm^2/s$ to 5.5 $mm^2/s$, and further preferably 3.0 to 5.0 $mm^2/s$.

In the case where the 100° C. kinematic viscosity of the base oil (A) is 2.0 $mm^2/s$ or more, the vaporization loss of the lubricating oil composition can be readily suppressed.

In the case where the 100° C. kinematic viscosity of the base oil (A) is 6.0 $mm^2/s$ or less, the power loss due to the viscosity resistance of the lubricating oil composition can be readily suppressed to facilitate the effect of improving the fuel consumption efficiency.

The viscosity index of the base oil (A) is preferably 100 or more, more preferably 110 or more, further preferably 120 or more, and still further preferably 130 or more, from the standpoint of suppressing the viscosity change due to the temperature change and also the enhancement of the fuel consumption efficiency.

In the case where the base oil (A) is a mixed base oil containing two or more kinds of base oils, the 100° C. kinematic viscosity and the viscosity index of the mixed base oil are preferably in the aforementioned ranges.

In the description herein, the 100° C. kinematic viscosity and the viscosity index mean values that are measured or calculated according to JIS K2283:2000.

In the lubricating oil composition according to the first embodiment, the content of the base oil (A) is preferably 95% by mass or less based on the total amount of the lubricating oil composition. The content of the base oil (A) that is 95% by mass or less can secure the sufficient amounts of the metal-based detergent (B), the ash-free friction modifier (C), and the molybdenum compound (D) used, so as to facilitate the effects of the present invention.

The content of the base oil (A) is preferably 75 to 95% by mass, more preferably 80 to 93% by mass, and further preferably 85 to 92% by mass, based on the total amount of the lubricating oil composition, from the standpoint of further facilitating the effects of the present invention.

<Metal-Based Detergent (B)>

The lubricating oil composition according to the first embodiment contains a metal-based detergent (B).

The metal-based detergent (B) contains a calcium-based detergent (B1) and a magnesium-based detergent (B2).

In the case where the lubricating oil composition according to the first embodiment does not contain any one or both of the calcium-based detergent (B1) and the magnesium-based detergent (B2), the initial base number of the lubricating oil composition cannot be regulated to the prescribed value or more, so as to fail to exert the effects of the present invention.

The lubricating oil composition according to the first embodiment may contain a metal-based detergent other than the calcium-based detergent (B1) and the magnesium-based detergent (B2) in such a range that does not impair the effects of the present invention. The total content of the calcium-based detergent (B1) and the magnesium-based detergent (B2) is preferably 80 to 100% by mass, more preferably 90 to 100% by mass, and further preferably 95 to 100% by mass, based on the total amount of the metal-based detergent (B), from the standpoint of further facilitating the effects of the present invention.

The calcium-based detergent (B1) and the magnesium-based detergent (B2) will be described in detail below.

(Calcium-Based Detergent (B1))

Examples of the calcium-based detergent (B1) include a calcium salt, such as a calcium sulfonate, a calcium phenate, and a calcium salicylate.

These compounds may be used alone or as a combination of two or more kinds thereof.

The calcium-based detergent (B1) is preferably one or more kind selected from a calcium sulfonate, a calcium phenate, and a calcium salicylate, and more preferably a calcium salicylate, from the standpoint of regulating the initial base number to the prescribed value or more and the standpoint of improving the base number retaining capability.

In the case where the calcium-based detergent (B1) contains a calcium salicylate, the content of the calcium salicylate is preferably 80 to 100% by mass, more preferably 90 to 100% by mass, and further preferably 95 to 100% by mass, based on the total amount of the calcium-based detergent (B1).

Examples of the calcium sulfonate include a compound represented by the following general formula (b1-1).

Examples of the calcium salicylate include a compound represented by the following general formula (b1-2).

Examples of the calcium phenate include a compound represented by the following general formula (b1-3).

The calcium-based detergent (B1) may be used alone or as a combination of two or more kinds thereof.

(b1-1)

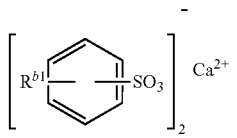

(b1-2)

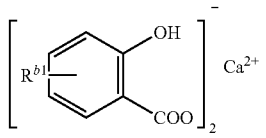

(b1-3)

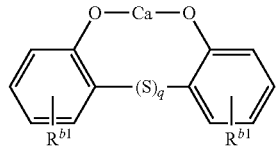

In the general formulae (b1-1) to (b1-3), $R^{b1}$ represents a hydrogen atom or a hydrocarbon group having 1 to 18 carbon atoms, and q represents an integer of 0 or more, and preferably an integer of 0 to 3.

Examples of the hydrocarbon group that can be selected as $R^{b1}$ include an alkyl group having 1 to 18 carbon atoms, an alkenyl group having 1 to 18 carbon atoms, a cycloalkyl group having 3 to 18 ring carbon atoms, an aryl group having 6 to 18 ring carbon atoms, an alkylaryl group having 7 to 18 carbon atoms, and an arylalkyl group having 7 to 18 carbon atoms.

The calcium-based detergent (B1) may be any of neutral, basic, and overbasic, and is preferably basic or overbasic, and more preferably overbasic, from the standpoint of regulating the initial base number to the prescribed value or more and the standpoint of further enhancing the base number retaining capability.

In the description herein, a metal-based detergent having a base number of less than 50 mgKOH/g is defined as "neutral", a metal-based detergent having a base number of 50 mgKOH/g to 150 mgKOH/g is defined as "basic", and a metal-based detergent having a base number of 150 mgKOH/g or more is defined as "overbasic".

In the description herein, the base number of the metal-based detergent (B) means a value that is measured by the potentiometric titration method (base number-perchloric acid method) according to JIS K2501:2003, Section 9.

In the case where the calcium-based detergent (B1) is the calcium sulfonate, the base number of the calcium sulfonate is preferably 5 mgKOH/g or more, more preferably 100 mgKOH/g or more, further preferably 150 mgKOH/g or more, and still further preferably 200 mgKOH/g or more, and is preferably 500 mgKOH/g or less, more preferably 450 mgKOH/g or less, and further preferably 400 mgKOH/g or less.

In the case where the calcium-based detergent (B1) is the calcium salicylate, the base number of the calcium salicylate is preferably 50 mgKOH/g or more, more preferably 100 mgKOH/g or more, further preferably 150 mgKOH/g or more, and still further preferably 200 mgKOH/g or more, and is preferably 500 mgKOH/g or less, more preferably 450 mgKOH/g or less, and further preferably 400 mgKOH/g or less.

In the case where the calcium-based detergent (B1) is the calcium phenate, the base number of the calcium phenate is preferably 50 mgKOH/g or more, more preferably 100 mgKOH/g or more, further preferably 150 mgKOH/g or more, and still further preferably 200 mgKOH/g or more, and is preferably 500 mgKOH/g or less, more preferably 450 mgKOH/g or less, and further preferably 400 mgKOH/g or less.

The lubricating oil composition according to the first embodiment preferably has a content of calcium atoms derived from the calcium-based detergent (B1) of 0.20% by mass or less, more preferably 0.17% by mass or less, and further preferably 0.15% by mass or less, based on the total amount of the lubricating oil composition, from the standpoint of reducing the friction coefficient in a wide temperature range including a low temperature range. The content of calcium atoms thereof is preferably 0.10% by mass or more, more preferably 0.11% by mass or more, and further preferably 0.12% by mass or more, from the standpoint of regulating the initial base number to the prescribed value or more and the standpoint of securing the base number retaining capability.

In the lubricating oil composition according to the first embodiment, the content of the calcium-based detergent (B1) may be regulated to satisfy the content of calcium atoms derived from the calcium-based detergent (B1) within the aforementioned range. Specifically, the content of the calcium-based detergent (B1) is preferably 1.2 to 2.5% by mass, more preferably 1.4 to 2.2% by mass, and further preferably 1.6 to 2.0% by mass, based on the total amount of the lubricating oil composition.

(Magnesium-Based Detergent (B2))

Examples of the magnesium-based detergent (B2) include a magnesium salt, such as a magnesium sulfonate, a magnesium phenate, and a magnesium salicylate.

These compounds may be used alone or as a combination of two or more kinds thereof.

The magnesium-based detergent (B2) is preferably one or more kind selected from a magnesium sulfonate, a magnesium phenate, and a magnesium salicylate, and more preferably a magnesium sulfonate, from the standpoint of regulating the initial base number to the prescribed value or more and the standpoint of improving the base number retaining capability.

In the case where the magnesium-based detergent (B2) contains a magnesium sulfonate, the content of the magnesium sulfonate is preferably 80 to 100% by mass, more preferably 90 to 100% by mass, and further preferably 95 to 100% by mass, based on the total amount of the magnesium-based detergent (B2).

Examples of the magnesium sulfonate include a compound represented by the following general formula (b2-1).

Examples of the magnesium salicylate include a compound represented by the following general formula (b2-2).

Examples of the magnesium phenate include a compound represented by the following general formula (b2-3).

The magnesium-based detergent (B2) may be used alone or as a combination of two or more kinds thereof.

(b2-1)

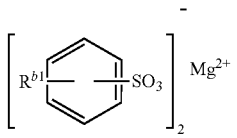

(b2-2)

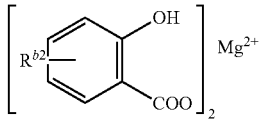

(b2-3)

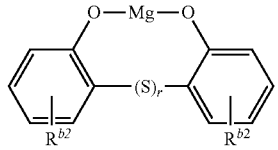

In the general formulae (b2-1) to (b2-3), $R^{b2}$ represents a hydrogen atom or a hydrocarbon group having 1 to 18 carbon atoms, and r represents an integer of 0 or more, and preferably an integer of 0 to 3.

Examples of the hydrocarbon group that can be selected as $R^{b2}$ include the same ones as exemplified for $R^{b1}$.

The magnesium-based detergent (B2) may be any of neutral, basic, and overbasic, and is preferably basic or overbasic, and more preferably overbasic, from the standpoint of regulating the initial base number to the prescribed value or more and the standpoint of further enhancing the base number retaining capability.

In the case where the magnesium-based detergent (B2) is the magnesium sulfonate, the base number of the magnesium sulfonate is preferably 5 mgKOH/g or more, more preferably 100 mgKOH/g or more, further preferably 300 mgKOH/g or more, and still further preferably 350 mgKOH/g or more, and is preferably 650 mgKOH/g or less, more preferably 500 mgKOH/g or less, and further preferably 450 mgKOH/g or less.

In the case where the magnesium-based detergent (B2) is the magnesium salicylate, the base number of the magnesium salicylate is preferably 50 mgKOH/g or more, more preferably 100 mgKOH/g or more, further preferably 200 mgKOH/g or more, and still further preferably 300 mgKOH/g or more, and is preferably 500 mgKOH/g or less, more preferably 450 mgKOH/g or less, and further preferably 400 mgKOH/g or less.

In the case where the magnesium-based detergent (B2) is the magnesium phenate, the base number of the magnesium phenate is preferably 50 mgKOH/g or more, more preferably 100 mgKOH/g or more, and further preferably 200 mgKOH/g or more, and is preferably 500 mgKOH/g or less, more preferably 450 mgKOH/g or less, and further preferably 400 mgKOH/g or less.

The lubricating oil composition according to the first embodiment preferably has a content of magnesium atoms derived from the magnesium-based detergent (B2) of 0.07% by mass or less, more preferably less than 0.07% by mass, further preferably 0.06% by mass or less, still further preferably 0.05% by mass or less, and still more further preferably 0.04% by mass or less, based on the total amount of the lubricating oil composition, from the standpoint of reducing the friction coefficient in a wide temperature range including a low temperature range. The content of magnesium atoms thereof is preferably 0.01% by mass or more, and more preferably 0.02% by mass or more, from the standpoint of regulating the initial base number to the prescribed value or more and the standpoint of securing the base number retaining capability.

In the lubricating oil composition according to the first embodiment, the content of the magnesium-based detergent (B2) may be regulated to satisfy the content of magnesium atoms derived from the magnesium-based detergent (B2) within the aforementioned range. Specifically, the content of the magnesium-based detergent (B2) is preferably 0.1 to 0.8% by mass, more preferably 0.1 to 0.6% by mass, further preferably 0.2 to 0.5% by mass, and still further preferably 0.2 to 0.4% by mass, based on the total amount of the lubricating oil composition.

(Content Ratio of Calcium-Based Detergent (B1) and Magnesium-Based Detergent (B2))

In the lubricating oil composition according to the first embodiment, the content ratio ((B1)/(B2)) of the calcium-based detergent (B1) and the magnesium-based detergent (B2) in terms of mass ratio is preferably 1.0 to 10, more preferably 2.0 to 9.5, further preferably 3.0 to 9.0, and still further preferably 4.0 to 8.0, from the standpoint of further facilitating the effects of the present invention.

<Ash-Free Friction Modifier (C)>

The lubricating oil composition according to the first embodiment contains an ash-free friction modifier (C).

The ash-free friction modifier (C) contains one or more kind selected from an amine-based friction modifier (C1) and an ether-based friction modifier (C2).

In the case where the lubricating oil composition according to the first embodiment does not contain both of the amine-based friction modifier (C1) and the ether-based friction modifier (C2), the effect of reducing the friction coefficient in a low temperature range is not exerted.

The lubricating oil composition according to the first embodiment may contain an ash-free friction modifier other than the amine-based friction modifier (C1) and the ether-based friction modifier (C2) in such a range that does not impair the effects of the present invention. The content of one or more kind selected from the amine-based friction modifier (C1) and the ether-based friction modifier (C2) is preferably 70 to 100% by mass, more preferably 80 to 100% by mass, and further preferably 90 to 100% by mass, based on the total amount of the ash-free friction modifier (C), from the standpoint of further facilitating the effects of the present invention.

The amine-based friction modifier (C1) and the ether-based friction modifier (C2) will be described in detail below.

(Amine-Based Friction Modifier (C1))

Examples of the amine-based friction modifier (C1) include an amine compound that is capable of functioning as a friction modifier, and preferably include an amine compound represented by the following general formula (c1).

These compounds may be used alone or as a combination of two or more kinds thereof.

In the case where the amine-based friction modifier (C1) contains one or more kind selected from the amine compound represented by the following general formula (c1), the content of one or more kind selected from the amine compound represented by the following general formula (c1) is preferably 80 to 100% by mass, more preferably 90 to 100% by mass, and further preferably 95 to 100% by mass, based on the total amount of the amine-based friction modifier (C1).

(c1)

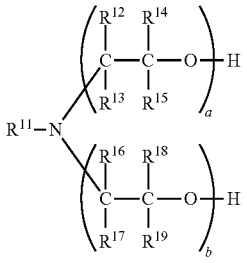

In the general formula (c1), $R^{11}$ represents a hydrocarbon group having 1 to 32 carbon atoms; $R^{12}$ to $R^{19}$ each independently represent a hydrogen atom, a hydrocarbon group having 1 to 18 carbon atoms, or an oxygen-containing hydrocarbon group containing an ether bond or an ester bond; and a and b each independently represent an integer of 1 to 20.

In the case where a is 2 or more, while plural groups exist for each of $R^{12}$ to $R^{15}$, the plural groups represented by $R^{12}$ may be the same as or different from each other, the plural groups represented by $R^{13}$ may be the same as or different from each other, the plural groups represented by $R^{14}$ may be the same as or different from each other, and the plural groups represented by $R^{15}$ may be the same as or different from each other.

In the case where b is 2 or more, while plural groups exist for each of R'6 to $R^{19}$, the plural groups represented by $R'^{6}$ may be the same as or different from each other, the plural groups represented by $R'^{7}$ may be the same as or different from each other, the plural groups represented by $R^{18}$ may be the same as or different from each other, and the plural groups represented by $R^{19}$ may be the same as or different from each other.

The number of carbon atoms of the hydrocarbon group represented by Rn is preferably 8 to 32, more preferably 10 to 24, and further preferably 12 to 20.

Examples of the hydrocarbon group represented by Rn include an alkyl group, an alkenyl group, an alkylaryl group, a cycloalkyl group, and a cycloalkenyl group. Among these, an alkyl group and an alkenyl group are preferred.

Examples of the alkyl group represented by Rn include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a henicosyl group, a docosyl group, a tricosyl group, and a tetracosyl group. These groups each may be linear, branched, or cyclic.

Examples of the alkenyl group represented by Rn include a vinyl group, a propenyl group, a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, an oleyl group, a nonadecenyl group, an icosenyl group, a henicosenyl group, a docosenyl group, a tricosenyl group, and a tetracosenyl group. These groups each may be linear, branched, or cyclic, and the position of the double bond is not limited.

The hydrocarbon group represented by $R^{12}$ to $R^{19}$ may be saturated or unsaturated, aliphatic or aromatic, and linear, branched, or cyclic, and examples thereof include an aliphatic hydrocarbon group, such as an alkyl group and an alkenyl group (in which the position of the double bond is not limited), and an aromatic hydrocarbon group. Examples of the hydrocarbon group include an aliphatic hydrocarbon group, such as a methyl group, an ethyl group, a propyl group, a butyl group, a butenyl group, a hexyl group, a hexenyl group, an octyl group, an octenyl group, a 2-ethylhexyl group, a nonyl group, a decyl group, an undecyl group, a decenyl group, a dodecyl group, a dodecenyl group, a tridecyl group, a tetradecyl group, a tetradecenyl group, a pentadecyl group, a hexadecyl group, a hexadecenyl group, a heptadecyl group, an octadecyl group, an octadecenyl group, a stearyl group, an isostearyl group, an oleyl group, a linoleic group, a cyclopentyl group, a cyclohexyl group, a methylcyclohexyl group, an ethylcyclohexyl group, a propylcyclohexyl group, a dimethylcyclohexyl group, and a trimethylcyclohexyl group; and an aromatic hydrocarbon group, such as a phenyl group, a methylphenyl group, an ethylphenyl group, a dimethylphenyl group, a propylphenyl group, a trimethylphenyl group, a butylphenyl group, and a naphthyl group.

In the case where $R^{12}$ to $R^{19}$ represent hydrocarbon groups, the numbers of carbon atoms of the hydrocarbon groups each are preferably 1 to 18, more preferably 1 to 12, further preferably 1 to 4, and still further preferably 2.

Examples of the oxygen-containing hydrocarbon group containing an ether bond or an ester bond include groups having 1 to 18 carbon atoms, and examples thereof include a methoxymethyl group, an ethoxymethyl group, a propoxymethyl group, an isopropoxymethyl group, a n-butoxymethyl group, a t-butoxymethyl group, a hexyloxymethyl group, an octyloxymethyl group, a 2-ethylhexyloxymethyl group, a decyloxymethyl group, a dodecyloxymethyl group, a 2-butyloctyloxymethyl group, a tetradecyloxymethyl group, a hexadecyloxymethyl group, a 2-hexyldodecyloxymethyl group, an allyloxymethyl group, a phenoxy group, a benzyloxy group, a methoxyethyl group, a methoxypropyl group, a 1,1-bismethoxypropyl group, a 1,2-bismethoxypropyl group, an ethoxypropyl group, a (2-methoxyethoxy)propyl group, a (1-methyl-2-methoxy) propyl group, an acetyloxymethyl group, a propanoyloxymethyl group, a butanoyloxymethyl group, a hexanoyloxymethyl group, an octanoyloxymethyl group, a 2-ethylhexanoyloxymethyl group, a decanoyloxymethyl group, a dodecanoyloxymethyl group, a 2-butyloctanoyloxymethyl group, a tetradecanoyloxymethyl group, a hexadecanoyloxymethyl group, a 2-hexyldodecanoyloxymethyl group, and a benzoyloxymethyl group.

$R^{12}$ to $R^{19}$ each independently preferably represent one kind selected from the group consisting of a hydrogen atom and a hydrocarbon group having 1 to 18 carbon atoms, and more preferably a hydrogen atom. All $R^{12}$ to $R^{19}$ preferably represent hydrogen atoms from the standpoint of further facilitating the effect of reducing the friction coefficient in a low temperature range.

a and b each independently preferably represent 1 to 10, more preferably 1 to 5, further preferably 1 to 2, and still further preferably 1, from the standpoint of further facilitating the effect of reducing the friction coefficient in a low temperature range.

The sum of the integers represented by a and b is preferably 2 to 20, more preferably 2 to 10, further preferably 2 to 4, and still further preferably 2, from the standpoint of further facilitating the effect of reducing the friction coefficient in a low temperature range.

Examples of the amine compound represented by the general formula (c1) include an amine compound having two 2-hydroxyalkyl groups, such as octyldiethanolamine, decyldiethanolamine, dodecyldiethanolamine, tetradecyldiethanolamine, hexadecyldiethanolamine, stearyldiethanolamine, oleyldiethanolamine, coconut oil diethanolamine, palm oil diethanolamine, rapeseed oil diethanolamine, and beef tallow diethanolamine; and an amine compound having two polyalkylene oxide structures, such as polyoxyethylene octylamine, polyoxyethylene decylamine, polyoxyethylene dodecylamine, polyoxyethylene tetradecylamine, polyoxyethylene hexadecylamine, polyoxyethylene stearylamine, polyoxyethylene oleylamine, polyoxyethylene beef tallow amine, polyoxyethylene coconut oil amine, polyoxyethylene palm oil amine, polyoxyethylene laurylamine, and ethylene oxide propylene oxide stearylamine. Among these, oleyldiethanolamine is preferred.

In the case where the lubricating oil composition according to the first embodiment contains the amine-based friction modifier (C1), the content of the amine-based friction modifier (C1) is necessarily more than 0.05% by mass based on the total amount of the lubricating oil composition. This is since in the case where the content of the amine-based friction modifier (C1) is 0.05% or less by mass based on the total amount of the lubricating oil composition, the effect of reducing the friction coefficient in a low temperature range is not exerted.

The content of the amine-based friction modifier (C1) is preferably 0.06% by mass or more, more preferably 0.08% by mass or more, further preferably 0.09% by mass or more, and still further preferably 0.10% by mass or more, based on the total amount of the lubricating oil composition, from the standpoint of further facilitating the effect of reducing the friction coefficient in a low temperature range.

The content of the amine-based friction modifier (C1) is preferably 0.30% by mass or less, and more preferably 0.20% by mass or less, based on the total amount of the lubricating oil composition, from the standpoint of achieving the effect corresponding to the content of the amine-based friction modifier (Ca (Ether-Based Friction Modifier (C2))

Examples of the ether-based friction modifier (C2) include an ether compound that is capable of functioning as a friction modifier, preferred examples thereof include a (poly)glycerin ether compound, and more preferred examples thereof include a (poly)glycerin ether compound represented by the following general formula (c2).

These compounds may be used alone or as a combination of two or more kinds thereof.

In the case where the ether-based friction modifier (C2) contains one or more kind selected from the (poly)glycerin ether compound represented by the following general formula (c2), the content of one or more kind selected from the (poly)glycerin ether compound represented by the following general formula (c2) is preferably 80 to 100% by mass, more preferably 90 to 100% by mass, and further preferably 95 to 100% by mass, based on the total amount of the ether-based friction modifier (C2).

In the description herein, the (poly)glycerin ether compound means both a glycerin ether and a polyglycerin ether.

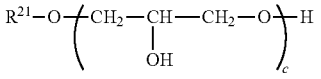

(c2)

In the general formula (c2), $R^{21}$ represents a hydrocarbon group, and c represents an integer of 1 to 10.

Examples of the hydrocarbon group represented by $R^{21}$ include an alkyl group having 1 to 30 carbon atoms, an alkenyl group having 3 to 30 carbon atoms, an aryl group having 6 to 30 carbon atoms, and an aralkyl group having 7 to 30 carbon atoms.

The alkyl group having 1 to 30 carbon atoms represented by $R^{21}$ may be any of linear, branched, and cyclic. Specific examples of the alkyl group include such groups as methyl, ethyl, propyl, isopropyl, butyl, isobutyl, tert-butyl, pentyl, isopentyl, neopentyl, tert-pentyl, hexyl, heptyl, octyl, 2-ethylhexyl, nonyl, decyl, undecyl, dodecyl, tridecyl, isotridecyl, tetradecyl, hexadecyl, octadecyl, icosyl, docosyl, tetracosyl, triacontyl, 2-octyldodecyl, 2-dodecylhexadecyl, 2-tetradecyloctadecyl, 16-methylheptadecyl, cyclopentyl, cyclohexyl, methylcyclohexyl, and cyclooctyl.

The alkenyl group having 3 to 30 carbon atoms represented by $R^{21}$ may be any of linear, branched, and cyclic, and the position of the double bond is not limited. Specific examples of the alkenyl group include a propenyl group, an isopropenyl group, a butenyl group, an isobutenyl group, a pentenyl group, an isopentenyl group, a hexenyl group, a heptenyl group, an octenyl group, a nonenyl group, a decenyl group, an undecenyl group, a dodecenyl group, a tetradecenyl group, an octadecenyl group, an oleyl group, a cyclopentenyl group, a cyclohexenyl group, a methylcyclopentenyl group, and a methylcyclohexenyl group.

Examples of the aryl group having 6 to 30 carbon atoms represented by $R^{21}$ include a phenyl group, a naphthyl group, a tolyl group, a xylyl group, a cumenyl group, a mesityl group, an ethylphenyl group, a propylphenyl group, a butylphenyl group, a pentylphenyl group, a hexylphenyl group, a heptylphenyl group, an octylphenyl group, and a nonylphenyl group.

Examples of the aralkyl group having 7 to 30 carbon atoms represented by $R^{21}$ include a benzyl group, a phenethyl group, a naphthylmethyl group, a benzhydryl group, a trityl group, a methylbenzyl group, and a methylphenethyl group.

$R^{21}$ preferably represents an alkyl group or an alkenyl group each having 8 to 20 carbon atoms from the standpoint of the capability and the availability of the (poly)glycerin ether compound represented by the general formula (c2), and the like.

c shows the polymerization degree of (poly)glycerin as a raw material of the (poly)glycerin ether compound represented by the general formula (c2), and represents an integer of 1 to 10, and preferably an integer of 1 to 3 from the standpoint of further facilitating the effect of reducing the friction coefficient in a low temperature range.

Examples of the (poly)glycerin ether compound represented by the general formula (c2) include glycerin monododecyl ether, glycerin monotetradecyl ether, glycerin monohexadecyl ether (which is the same as chimyl alcohol), glycerin monooctadecyl ether (which is the same as batyl alcohol), glycerin monooleyl ether (which is the same as selachyl alcohol), diglycerin monododecyl ether, diglycerin monotetradecyl ether, diglycerin monohexadecyl ether, diglycerin monooctadecyl ether, diglycerin monooleyl ether, triglycerin monododecyl ether, triglycerin monotetradecyl ether, triglycerin monohexadecyl ether, triglycerin monooctadecyl ether, and triglycerin monooleyl ether.

In the case where the lubricating oil composition according to the first embodiment contains the ether-based friction modifier (C2), the content of the ether-based friction modifier (C2) is preferably 0.10% by mass or more, more preferably 0.12% by mass or more, and further preferably 0.14% by mass or more, based on the total amount of the lubricating oil composition, from the standpoint of facilitating the effect of reducing the friction coefficient in a low temperature range.

The content of the ether-based friction modifier (C2) is preferably 0.50% by mass or less, and more preferably 0.40% by mass or less, based on the total amount of the lubricating oil composition, from the standpoint of achieving the effect corresponding to the content of the ether-based friction modifier (C2).

(Content Ratio of Amine-Based Friction Modifier (C1) and Ether-Based Friction Modifier (C2))

The lubricating oil composition according to the first embodiment preferably contains both the amine-based friction modifier (C1) and the ether-based friction modifier (C2) as the ash-free friction modifier (C) from the standpoint of further facilitating the effects of the present invention.

The content ratio ((C1)/(C2)) of the amine-based friction modifier (C1) and the ether-based friction modifier (C2) in terms of mass ratio is preferably 0.20 to 1.00, more preferably 0.25 to 0.80, further preferably 0.25 to 0.75, and still further preferably 0.30 to 0.70, from the standpoint of further facilitating the effects of the present invention.

In the case where the lubricating oil composition according to the first embodiment contains both the amine-based friction modifier (C1) and the ether-based friction modifier (C2), the total content thereof is preferably 0.10 to 0.60% by mass, more preferably 0.15 to 0.55% by mass, and further preferably 0.20 to 0.50% by mass, based on the total amount of the lubricating oil composition.

(Ester-Based Friction Modifier)

While the lubricating oil composition according to the first embodiment may further contain an ester-based friction modifier as the ash-free friction modifier (C), the content of the ester-based friction modifier is preferably smaller from the standpoint of further facilitating the effects of the present invention.

Specifically, the content of the ester-based friction modifier is preferably less than 30% by mass, more preferably less than 20% by mass, further preferably less than 10% by mass, still further preferably less than 5% by mass, still more further preferably less than 1% by mass, still more further preferably less than 0.1% by mass, and still more further preferably less than 0.01% by mass, and it is still more further preferred that the ester-based friction modifier is not contained.

Examples of the ester-based friction modifier include one or more kind selected from a partial ester compound obtained through reaction of a fatty acid and an aliphatic polyhydric alcohol.

The fatty acid is preferably a fatty acid having a linear or branched hydrocarbon group having 6 to 30 carbon atoms, and the number of carbon atoms of the hydrocarbon group is more preferably 8 to 24, and further preferably 10 to 20.

The aliphatic polyhydric alcohol may be a dihydric to hexahydric alcohol, and examples thereof include ethylene glycol, glycerin, trimethylolpropane, pentaerythritol, and sorbitol.

<Molybdenum Compound (D)>

The lubricating oil composition according to the first embodiment contains a molybdenum compound (D). The lubricating oil composition according to the first embodiment necessarily has a content of molybdenum atoms derived from the molybdenum compound (D) of 0.05% by mass or more based on the total amount of the lubricating oil composition. In the case where the content of molybdenum atoms derived from the molybdenum compound (D) is less than 0.05% by mass based on the total amount of the lubricating oil composition, the effect of reducing the friction coefficient in a low temperature range is not exerted. The effect of reducing the friction coefficient in a high temperature range may also be not exerted.

In this standpoint, the content of molybdenum atoms derived from the molybdenum compound (D) is preferably 0.06% by mass or more, and more preferably 0.07% by mass or more, and is preferably 0.20% by mass or less, more preferably 0.15% by mass or less, and further preferably 0.10% by mass or less.

Examples of the molybdenum compound (D) include a molybdenum dithiocarbamate (D1), a molybdenum dithiophosphate (D2), and a dialkylamine molybdate (D3).

These compounds may be used alone or as a combination of two or more kinds thereof.

Among these, the molybdenum compound (D) preferably contains a molybdenum dithiocarbamate (D1) from the standpoint of further facilitating the effects of the present invention.

In the case where the molybdenum compound (D) contains a molybdenum dithiocarbamate (D1), the content of the molybdenum dithiocarbamate (D1) is preferably 50 to 100% by mass, more preferably 60 to 100% by mass, and further preferably 70 to 100% by mass, based on the total amount of the molybdenum compound (D).

It is preferred that the molybdenum compound (D) contains the molybdenum dithiocarbamate (D1) and simultaneously contains one or more kind selected from the molybdenum dithiophosphate (D2) and the dialkylamine molybdate (D3), and more preferably the molybdenum dithiophosphate (D2), from the standpoint of facilitating the effects of the present invention.

In the case where the molybdenum compound (D) contains the molybdenum dithiocarbamate (D1), the molybdenum dithiophosphate (D2), and the dialkylamine molybdate (D3), the total content of the molybdenum dithiocarbamate (D1), the molybdenum dithiophosphate (D2), and the dialkylamine molybdate (D3) is preferably 70 to 100% by mass, more preferably 80 to 100% by mass, and further preferably 90 to 100% by mass, based on the total amount of the molybdenum compound (D).

In the case where the molybdenum compound (D) contains the molybdenum dithiocarbamate (D1) and the molybdenum dithiophosphate (D2), the total content of the molybdenum dithiocarbamate (D1) and the molybdenum dithiophosphate (D2) is preferably 70 to 100% by mass, more preferably 80 to 100% by mass, and further preferably 90 to 100% by mass, based on the total amount of the molybdenum compound (D).

The molybdenum dithiocarbamate (D1), the molybdenum dithiophosphate (D2), and the dialkylamine molybdate (D3) will be described in detail below.

(Molybdenum Dithiocarbamate (D1))

The lubricating oil composition according to the first embodiment contains the molybdenum dithiocarbamate (D1).

Examples of the molybdenum dithiocarbamate (D1) include a binuclear molybdenum dithiocarbamate containing two molybdenum atoms in one molecule and a trinuclear molybdenum dithiocarbamate containing three molybdenum atoms in one molecule.

These compounds may be used alone or as a combination of two or more kinds thereof.

The molybdenum dithiocarbamate (D1) is preferably a binuclear molybdenum dithiocarbamate from the standpoint of facilitating the effect of reducing the friction coefficient.

In the case where the molybdenum dithiocarbamate (D1) contains a binuclear molybdenum dithiocarbamate, the content of the binuclear molybdenum dithiocarbamate is preferably 80 to 100% by mass, more preferably 90 to 100% by mass, and further preferably 95 to 100% by mass, based on the total amount of the molybdenum dithiocarbamate (D1).

The binuclear molybdenum dithiocarbamate is preferably one or more kind selected from a compound represented by the following general formula (d1-1) and a compound represented by the following general formula (d1-2).

(d1-1)

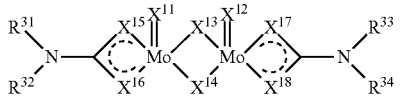

(d1-2)

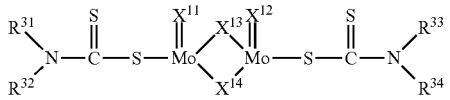

In the general formulae (d1-1) and (d1-2), $R^{31}$ to $R^{34}$ each independently represent a hydrocarbon group, and may be the same as or different from each other.

$X^{11}$ to $X^{18}$ each independently represent an oxygen atom or a sulfur atom, and may be the same as or different from each other, provided that at least two of $X^{11}$ to $X^{18}$ in the formula (d1-1) are sulfur atoms. It is preferred in the formula (d1-1) that $X^{11}$ and $X^{12}$ are oxygen atoms, and $X^{13}$ to $X^{18}$ are sulfur atoms.

In the general formula (d1-1), the molar ratio (sulfur atom/oxygen atom) of sulfur atoms and oxygen atoms in $X^{11}$ to $X^{18}$ is preferably 1/4 to 4/1, and more preferably 1/3 to 3/1, from the standpoint of enhancing the solubility to the base oil (A).

In the formula (d1-2), $X^{11}$ to $X^{14}$ are preferably oxygen atoms.

The number of carbon atoms of the hydrocarbon group that can be selected as $R^{31}$ to $R^{34}$ is preferably 6 to 22, more preferably 7 to 18, further preferably 7 to 14, and still further preferably 8 to 13.

Examples of the hydrocarbon group that can be selected as $R^{31}$ to $R^{34}$ in the general formulae (d1-1) and (d1-2) include an alkyl group, an alkenyl group, a cycloalkyl group, an aryl group, an alkylaryl group, and an arylalkyl group, and an alkyl group is preferred.

Examples of the alkyl group include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of the alkenyl group include a hexenyl group, a heptenyl group, an octenyl group, a nonenyl group, a decenyl group, an undecenyl group, a dodecenyl group, a tridecenyl group, a tetradecenyl group, and a pentadecenyl group.

Examples of the cycloalkyl group include a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group.

Examples of the aryl group include a phenyl group, a naphthyl group, an anthracenyl group, a biphenyl group, and a terphenyl group.

Examples of the alkylaryl group include a tolyl group, a dimethylphenyl group, a butylphenyl group, a nonylphenyl group, and a dimethylnaphthyl group.

Examples of the arylalkyl group include a methylbenzyl group, a phenylmethyl group, a phenylethyl group, and a diphenylmethyl group.

The trinuclear molybdenum dithiocarbamate is preferably a compound represented by the following general formula (d1-3).

$$Mo_3S_kE_mL_nA_pQ_z \quad \text{(d1-3)}$$

In the general formula (d1-3), k represents an integer of 1 or more, and m represents an integer of 0 or more, provided that k+m is an integer of 4 to 10, and preferably an integer of 4 to 7, n represents an integer of 1 to 4, p represents an integer of 0 or more, and z represents an integer of 0 to 5, which include non-stoichiometric values.

E each independently represent an oxygen atom or a selenium atom. L each independently represent an anionic ligand having an organic group containing carbon atoms, provided that the total number of carbon atoms of the organic group in each of the ligands is 14 or more, and the ligands may be the same as or different from each other.

A each independently represent an anion other than L.

Q each independently represent a neutral compound donating an electron, and exist for occupying the vacant coordination position on the trinuclear molybdenum compound.

In the case where the lubricating oil composition according to the first embodiment contains the molybdenum dithiocarbamate (D1), the content of molybdenum atoms derived from the molybdenum dithiocarbamate (D1) is preferably 0.05% by mass or more, and more preferably 0.06% by mass or more, based on the total amount of the lubricating oil composition, from the standpoint of further facilitating the effect of reducing the friction coefficient, and is generally 0.15% by mass or less, more preferably 0.12% by mass or less, and further preferably 0.10% by mass or less.

In the lubricating oil composition according to the first embodiment, the content of the molybdenum dithiocarbamate (D1) may be regulated to satisfy the content of molybdenum atoms derived from the molybdenum dithiocarbamate (D1) within the aforementioned range. Specifically, the content of the molybdenum dithiocarbamate (D1) is preferably 0.40 to 2.0% by mass, more preferably 0.45 to 1.0% by mass, and further preferably 0.50 to 0.90% by mass, based on the total amount of the lubricating oil composition.

(Molybdenum Dithiophosphate (D2))

Examples of the molybdenum dithiophosphate (D2) include a molybdenum dithiophosphate containing two molybdenum atoms in one molecule represented by the following general formula (d2-1) or (d2-2).

(d2-1)

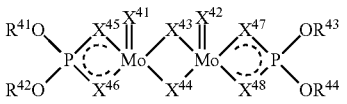

-continued (d2-2)

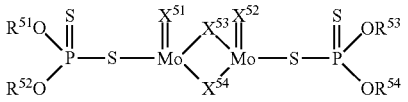

$R^{41}$ to $R^{44}$ in the general formula (d2-1) and $R^{51}$ to $R^{54}$ in the general formula (d2-2) each independently represent a hydrocarbon group having 1 to 30 carbon atoms, and may be the same as or different from each other.

$X^{41}$ to $X^{48}$ in the general formula (d2-1) and $X^{51}$ to $X^{54}$ in the general formula (d2-2) each independently represent an oxygen atom or a sulfur atom, may be the same as or different from each other, and at least one of each of $X^{43}$ and $X^{44}$, $X^{45}$ and $X^{46}$, $X^{47}$ and $X^{48}$, and $X^{53}$ and $X^{54}$ is a sulfur atom.

Examples of the hydrocarbon group represented by $R^{41}$ to $R^{44}$ and $R^{51}$ to $R^{54}$ include an alkyl group, an alkenyl group, a cycloalkyl group, an aryl group, an alkylaryl group, and an arylalkyl group, in which an alkyl group and alkenyl group are preferred, and an alkyl group is more preferred, from the standpoint of reducing the friction coefficient and the enhancement of the copper corrosion resistance.

From the same standpoint, the number of carbon atoms of the hydrocarbon group represented by $R^{41}$ to $R^{44}$ and $R^{51}$ to $R^{54}$ is preferably 2 or more, more preferably 4 or more, further preferably 8 or more, and still further preferably 10 or more, and the upper limit thereof is preferably 24 or less, more preferably 20 or less, further preferably 18 or less, and still further preferably 16 or less.

In the general formula (d2-1), at least two of $X^{41}$ to $X^{48}$ are sulfur atoms as described above, and it is preferred that $X^{41}$ and $X^{42}$ are oxygen atoms, and $X^{43}$ to $X^{48}$ are sulfur atoms.

In the general formula (d2-2), $X^{51}$ to $X^{54}$ are preferably oxygen atoms.

In the case where the lubricating oil composition according to the first embodiment contains the molybdenum dithiophosphate (D2), the content of molybdenum atoms derived from the molybdenum dithiophosphate (D2) is preferably 0.01% by mass or more, and more preferably 0.02% by mass or more, based on the total amount of the lubricating oil composition, from the standpoint of further facilitating the effect of reducing the friction coefficient, and is preferably 0.10% by mass or less, more preferably 0.07% by mass or less, and further preferably 0.04% by mass or less, from the standpoint of suppressing the catalyst poisoning of the exhaust emission control device by suppressing the phosphorus atom content in the lubricating oil composition.

In the lubricating oil composition according to the first embodiment, the content of the molybdenum dithiophosphate (D2) may be regulated to satisfy the content of molybdenum atoms derived from the molybdenum dithiophosphate (D2) within the aforementioned range. Specifically, the content of the molybdenum dithiophosphate (D2) is preferably 0.12 to 1.0% by mass, more preferably 0.15 to 0.50% by mass, and further preferably 0.18 to 0.25% by mass, based on the total amount of the lubricating oil composition.

(Dialkylamine Molybdate (D3))

The dialkylamine molybdate (D3) is a reaction product of a hexavalent molybdenum compound, such as one or more kind selected from molybdenum trioxide and molybdic acid, and a dialkylamine.

The dialkylamine to be reacted with the hexavalent molybdenum compound is not particularly limited, and examples thereof include a dialkylamine having an alkyl group having 1 to 30 carbon atoms.

In the case where the lubricating oil composition according to the first embodiment contains the dialkylamine molybdate (D3), the content of molybdenum atoms derived from the dialkylamine molybdate (D3) is preferably 0.01% by mass or more based on the total amount of the lubricating oil composition, from the standpoint of further facilitating the effect of reducing the friction coefficient, and is generally 0.04% by mass or less.

In the lubricating oil composition according to the first embodiment, the content of the dialkylamine molybdate (D3) may be regulated to satisfy the content of molybdenum atoms derived from the dialkylamine molybdate (D3) within the aforementioned range. Specifically, the content of the molybdenum dithiophosphate (D3) is preferably 0.06 to 1.0% by mass, more preferably 0.08 to 0.50% by mass, and further preferably 0.10 to 0.20% by mass, based on the total amount of the lubricating oil composition.

<Content Ratio of Molybdenum Dithiocarbamate (D1) to Molybdenum Dithiophosphate (D2) and Dialkylamine Molybdate (D3)>

The lubricating oil composition according to the first embodiment preferably contains the molybdenum dithiocarbamate (D1) and one or more kind selected from the molybdenum dithiophosphate (D2) and the dialkylamine molybdate (D3) in combination, and more preferably contains the molybdenum dithiocarbamate (D1) and the molybdenum dithiophosphate (D2) in combination, from the standpoint of further facilitating the effects of the present invention.

In this case, the content ratio ((D1)/(D2+D3)) of the molybdenum dithiocarbamate (D1) and one or more kind selected from the molybdenum dithiophosphate (D2) and the dialkylamine molybdate (D3) in terms of mass ratio is preferably 1.0 to 6.0, more preferably 1.5 to 5.0, further preferably 2.0 to 4.0, and still further preferably 2.0 to 3.0.

In the case where the lubricating oil composition according to the first embodiment contains the molybdenum dithiocarbamate (D1) and one or more kind selected from the molybdenum dithiophosphate (D2) and the dialkylamine molybdate (D3), the content of molybdenum atoms derived from the molybdenum compounds (D) is preferably 0.05% by mass or more, and more preferably 0.06% by mass or more, based on the total amount of the lubricating oil composition, from the standpoint of further facilitating the effect of reducing the friction coefficient, and is generally 0.15% by mass or less, preferably 0.10% by mass or less, and more preferably 0.08% by mass or less.

In the case where the lubricating oil composition according to the first embodiment contains the molybdenum dithiocarbamate (D1) and one or more kind selected from the molybdenum dithiophosphate (D2) and the dialkylamine molybdate (D3), the total content thereof may be regulated to satisfy the content of molybdenum atoms derived from the molybdenum compounds (D) within the aforementioned range. Specifically, the total content thereof is preferably 0.50 to 3.0% by mass, more preferably 0.60 to 1.0% by mass, further preferably 0.65 to 0.90% by mass, still further preferably 0.65 to 0.80% by mass, and still more further preferably 0.65 to 0.75% by mass, based on the total amount of the lubricating oil composition.

<Additive for Lubricating Oil>

The lubricating oil composition according to the first embodiment may contain an additional additive for a lubricating oil that does not corresponds to the component (B), the component (C), and the component (D), in such a range that does not impair the effects of the present invention.

Examples of the additional additive for a lubricating oil include an antioxidant, an ashless dispersant, a pour point depressant, a viscosity index improver, an anti-wear agent, an extreme pressure agent, a rust inhibitor, an anti-foaming agent, a metal deactivator, and a demulsifier.

The additives for a lubricating oil may be used alone or as a combination of two or more kinds thereof.

The contents of the additives for a lubricating oil each may be regulated within a range that does not impair the effects of the present invention, and each are independently generally 0.001 to 15% by mass, preferably 0.005 to 10% by mass, more preferably 0.01 to 8% by mass, and further preferably 0.1 to 6% by mass, based on the total amount (100% by mass) of the lubricating oil composition.

(Antioxidant)

Examples of the antioxidant include an amine-based antioxidant, a phenol-based antioxidant, a sulfur-based antioxidant, and a phosphorus-based antioxidant.

These compounds may be used alone or as a combination of two or more kinds thereof.

Among these, an amine-based antioxidant and a phenol-based antioxidant are preferably used, and both an amine-based antioxidant and a phenol-based antioxidant are more preferably used in combination.

Examples of the amine-based antioxidant include a diphenylamine-based antioxidant, such as diphenylamine and an alkylated diphenylamine having an alkyl group having 3 to 20 carbon atoms; and a naphthylamine-based antioxidant, such as an α-naphthylamine and a phenyl-α-naphthylamine substituted with an alkyl group having 3 to 20 carbon atoms.

Examples of the phenol-based antioxidant include a monophenol-based antioxidant, such as 2,6-di-tert-butyl-4-methylphenol, 2,6-di-tert-butyl ethylphenol, and octadecyl-3-(3,5-di-tert-butyl-4-hydroxyphenyl) propionate; a diphenol-based antioxidant, such as 4,4'-methylenebis(2,6-di-tert-butylphenol) and 2,2'-methylenebis(4-ethyl-6-tert-butylphenol); and a hindered phenol-based antioxidant.

(Ashless Dispersant)

Examples of the ashless dispersant include a boron-non-containing succinimide compound, such as a boron-non-containing alkenylsuccinimide, a boron-containing succinimide compound, such as a boron-containing alkenylsuccinimide, a benzylamine compound, a boron-containing benzylamine compound, a succinate ester compound, and a monovalent or divalent carboxylic acid amide represented by a fatty acid or succinic acid.

These compounds may be used alone or as a combination of two or more kinds thereof.

Among these, a boron-non-containing alkenylsuccinimide and a boron-containing alkenylsuccinimide are preferably used, and both a boron-non-containing alkenylsuccinimide and a boron-containing alkenylsuccinimide are more preferably used in combination.

(Pour Point Depressant)

Examples of the pour point depressant include an ethylene-vinyl acetate copolymer, a condensate of chlorinated paraffin and naphthalene, a condensate of chlorinated paraffin and phenol, a polymethacrylate, and a polyalkylstyrene.

These compounds may be used alone or as a combination of two or more kinds thereof.

(Viscosity Index Improver)

Examples of the viscosity index improver include polymers, for example, a non-dispersive polymethacrylate, a dispersive polymethacrylate, an olefin-based copolymer (such as an ethylene-propylene copolymer), a dispersive olefin-based copolymer, and a styrene-based copolymer (such as a styrene-diene copolymer and a styrene-isoprene copolymer).

These compounds may be used alone or as a combination of two or more kinds thereof.

The mass average molecular weight (Mw) of the viscosity index improver is generally 500 to 1,000,000, preferably 5,000 to 100,000, and more preferably 10,000 to 50,000, and may be appropriately set depending on the kind of the polymer.

In the description herein, the mass average molecular weight (Mw) of each of the components is a standard polystyrene conversion value measured by the gel permeation chromatography (GPC) method.

(Anti-Wear Agent or Extreme Pressure Agent)

Examples of the anti-wear agent or the extreme pressure agent include a sulfur-containing compound, such as a zinc dialkyldithiophosphate (ZnDTP), zinc phosphate, zinc dithiocarbamate, a sulfide compound, a sulfurized olefin compound, a sulfurized fat or oil compound, a sulfurized ester compound, a thiocarbonate compound, a thiocarbamate compound, and a polysulfide compound; a phosphorus-containing compound, such as a phosphite ester compound, a phosphate ester compound, a phosphonate ester compound, and amine salts and metal salts thereof; and a sulfur and phosphorus-containing anti-wear agent, such as a thiophosphite ester compound, a thiophosphate ester compound, a thiophosphonate ester compound, and amine salts and metal salts thereof.

These compounds may be used alone or as a combination of two or more kinds thereof.

Among these, a zinc dialkyldithiophosphate (ZnDTP) is preferred.

(Rust Inhibitor)

Examples of the rust inhibitor include a fatty acid, an alkenyl succinate half ester, a fatty acid soap, an alkylsulfonate salt, a polyhydric alcohol fatty acid ester, a fatty acid amine, oxidized paraffin, and an alkyl polyoxyethylene ether.

These compounds may be used alone or as a combination of two or more kinds thereof.

(Anti-Foaming Agent)

Examples of the anti-foaming agent include a silicone oil, a fluorosilicone oil, and a fluoroalkyl ether.

These compounds may be used alone or as a combination of two or more kinds thereof.

(Metal Deactivator)

Examples of the metal deactivator include a benzotriazole-based compound, a tolyltriazole-based compound, a thiadiazole-based compound, an imidazole-based compound, and a pyrimidine-based compound.

These compounds may be used alone or as a combination of two or more kinds thereof.

(Demulsifier)

Examples of the demulsifier include an anionic surfactant, such as a sulfate ester salt of castor oil and a petroleum sulfonate salt; a cationic surfactant, such as a quaternary ammonium salt and an imidazoline compound; a polyoxyalkylene polyglycol and a dicarboxylate ester thereof, and an alkylene oxide adduct of an alkylphenol-formaldehyde polycondensate.

These compounds may be used alone or as a combination of two or more kinds thereof.

[Embodiment of Lubricating Oil Composition According to Second Embodiment]

The lubricating oil composition according to the second embodiment is a lubricating oil composition used in a gasoline engine, containing

- a base oil (A),
- a metal-based detergent (B) containing a calcium-based detergent (B1) and a magnesium-based detergent (B2), and
- a molybdenum compound (D),
- the molybdenum compound (D) contains one or more kind selected from a molybdenum dithiocarbamate (D1), a molybdenum dithiophosphate (D2), and a dialkylamine molybdate (D3), and
- the lubricating oil composition has
- a content of Mo atoms derived from the molybdenum compound (D) of 0.05% by mass or more based on the total amount of the lubricating oil composition,
- a base number measured by a hydrochloric acid method of 4.0 mgKOH/g or more, and
- an HTHS viscosity at 150° C. of 1.3 mPa·s or more and less than 2.3 mPa·s.

The lubricating oil composition according to the second embodiment can reduce the friction coefficient in a wide temperature range including a low temperature range, and can also secure the prescribed initial base number, while the lubricating oil composition has such a low viscosity as an HTHS viscosity at 150° C. of 1.3 mPa·s or more and less than 2.3 mPa s, by the combination use of the particular metal-based detergents, the combination use of the particular molybdenum compound, the regulation of the molybdenum atom content derived from the molybdenum compound, and the regulation of the base number.

The lubricating oil composition according to the second embodiment does not necessitate the amine-based friction modifier (C1) and the ether-based friction modifier (C2) as the essential constitutional components, as different from the lubricating oil composition according to the first embodiment. The lubricating oil composition according to the second embodiment can reduce the friction coefficient in a wide temperature range including a low temperature range, irrespective of the fact that the amine-based friction modifier (C1) and the ether-based friction modifier (C2) are not necessitated as the essential constitutional components.

The lubricating oil composition according to the second embodiment may contain an additive for a lubricating oil other than the component (A), the component (B), and the component (D), in such a range that does not impair the effects of the present invention.

In the lubricating oil composition according to the second embodiment, the total content of the component (A), the component (B), and the component (D) is preferably 80% by mass or more, more preferably 85% by mass or more, and further preferably 90% by mass or more, based on the total amount of the lubricating oil composition.

In the lubricating oil composition according to the second embodiment, the upper limit value of the total content of the component (A), the component (B), and the component (D) may be regulated in relation to the content of the additive for a lubricating oil other than the component (A), the component (B), and the component (D), and is preferably 97% by mass or less, more preferably 95% by mass or less, and further preferably 93% by mass or less.

The lubricating oil composition according to the second embodiment contains a molybdenum compound (D). The lubricating oil composition according to the second embodiment necessarily has a content of molybdenum atoms derived from the molybdenum compound (D) of 0.05% by mass or more based on the total amount of the lubricating oil composition. In the case where the content of molybdenum atoms derived from the molybdenum compound (D) is less than 0.05% by mass based on the total amount of the lubricating oil composition, the effect of reducing the friction coefficient in a low temperature range is not exerted. The effect of reducing the friction coefficient in a high temperature range is also not exerted.

In this standpoint, the content of molybdenum atoms derived from the molybdenum compound (D) is preferably 0.06% by mass or more, and more preferably 0.07% by mass or more, and is preferably 0.20% by mass or less, more preferably 0.15% by mass or less, and further preferably 0.10% by mass or less.

While the lubricating oil composition according to the second embodiment may contain an ash-free friction modifier (C), the content thereof is preferably smaller from the standpoint of further facilitating the effects of the present invention. Specifically, in the lubricating oil composition according to the second embodiment, the content of one or more kind of an ash-free friction modifier (C) selected from an amine-based friction modifier (C1) and an ether-based friction modifier (C2) is preferably less than 0.10 part by mass, more preferably less than 0.01 part by mass, and further preferably less than 0.001 part by mass, based on the total amount of the lubricating oil composition, and it is most preferred that the ash-free friction modifier (C) is not contained.

The component (A), the component (B), the component (D), and the additional additives for a lubricating oil contained in the lubricating oil composition according to the second embodiment are the same as those described above for the lubricating oil composition according to the first embodiment, and the preferred embodiments thereof are also the same. Accordingly, the detailed description thereof are omitted herein.

From the standpoint of facilitating the reduction of the friction coefficient, it is preferred that the molybdenum dithiocarbamate (D1) and the molybdenum dithiophosphate (D2) are used in combination, and the molybdenum dithiocarbamate (D1) and the dialkylamine molybdate (D3) are used in combination, and it is more preferred that the molybdenum dithiocarbamate (D1) and the dialkylamine molybdate (D3) are used in combination.

<Content Ratio of Molybdenum Dithiocarbamate (D1) and One or More Kind Selected from Molybdenum Dithiophosphate (D2) and Dialkylamine Molybdate (D3)>

The lubricating oil composition according to the second embodiment preferably has a content ratio ((D1)/(D2+D3)) of the molybdenum dithiocarbamate (D1) and one or more kind selected from the molybdenum dithiophosphate (D2) and the dialkylamine molybdate (D3) in terms of mass ratio of 1.0 to 7.5, more preferably 1.5 to 6.5, and further preferably 2.0 to 5.5, from the standpoint of further facilitating the effects of the present invention.

<Embodiment Combining Molybdenum Dithiocarbamate (D1) and Dialkylamine Molybdate (D3)>

The lubricating oil composition according to the second embodiment preferably contains the molybdenum dithiocarbamate (D1) and the dialkylamine molybdate (D3) in combination as described above from the standpoint of further facilitating the effects of the present invention.

In this case, the content ratio ((D1)/(D3)) of the molybdenum dithiocarbamate (D1) and the dialkylamine molybdate (D3) in terms of mass ratio is preferably 1.0 to 7.5, more preferably 2.0 to 6.5, further preferably 3.0 to 6.0, still further preferably 4.0 to 6.0, and still more further preferably 5.0 to 6.0.

In the case where the molybdenum dithiocarbamate (D1) and the dialkylamine molybdate (D3) are used in combination, the content of molybdenum atoms derived from the molybdenum dithiocarbamate (D1) and the dialkylamine molybdate (D3) is preferably 0.05% by mass or more, more preferably 0.06% by mass or more, and further preferably 0.07% by mass or more, based on the total amount of the lubricating oil composition, from the standpoint of further facilitating the effect of reducing the friction coefficient, and is generally 0.15% by mass or less, preferably 0.10% by mass or less, and more preferably 0.09% by mass or less.

In the case where the molybdenum dithiocarbamate (D1) and the dialkylamine molybdate (D3) are used in combination, the total content thereof may be regulated to satisfy the content of molybdenum atoms derived from the molybdenum compounds (D) within the aforementioned range. Specifically, the total content thereof is preferably 0.50 to 3.0% by mass, more preferably 0.60 to 2.0% by mass, further preferably 0.65 to 1.0% by mass, still further preferably 0.70 to 0.95% by mass, and still more further preferably 0.75 to 0.90% by mass, based on the total amount of the lubricating oil composition.

[Properties of Lubricating Oil Composition]

In the following description, the "lubricating oil composition according to the first embodiment" and the "lubricating oil composition according to the second embodiment" may be generically referred to as the "lubricating oil composition according to the present embodiment".

<100° C. Kinematic Viscosity>

The 100° C. kinematic viscosity of the lubricating oil composition according to the present embodiment is preferably 3.8 $mm^2/s$ or more and less than 8.2 $mm^2/s$, more preferably 3.8 $mm^2/s$ or more and less than 7.1 $mm^2/s$, and further preferably 3.8 $mm^2/s$ or more and less than 6.1 $mm^2/s$.

<HTHS Viscosity at 150° C.>

The HTHS viscosity at 150° C. of the lubricating oil composition according to the present embodiment is 1.3 mPa·s or more and less than 2.3 mPa·s.

In the case where the HTHS viscosity of the lubricating oil composition of the present invention is less than 1.3 mPa·s, the oil film is difficult to retain, and in the case where the HTHS viscosity thereof is 2.3 mPa·s or more, the fuel consumption efficiency is lowered.

In this standpoint, the HTHS viscosity at 150° C. of the lubricating oil composition according to the present embodiment is preferably 1.4 mPa·s or more and less than 2.0 mPa·s, more preferably 1.5 mPa·s or more and 1.9 mPa·s or less, and further preferably 1.6 mPa·s or more and 1.9 mPa·s or less.

In the description herein, the HTHS viscosity at 150° C. of the lubricating oil composition is a value that is measured according to ASTM D4683 with a TBS high temperature viscometer (tapered bearing simulator viscometer) under a temperature condition of 150° C. at a shear velocity of $10^6/s$.

<Base Number>

The base number measured by the hydrochloric acid method (initial base number) of the lubricating oil composition according to the present embodiment is necessarily 4.0 mgKOH/g or more. In the case where the base number measured by the hydrochloric acid method is less than 4.0 mgKOH/g, the initial base number of the lubricating oil composition cannot be set to the prescribed value, which makes difficult to secure the long drain property of the lubricating oil composition.

In this standpoint, the base number measured by the hydrochloric acid method of the lubricating oil composition according to the present embodiment is preferably 4.5 mgKOH/g or more, more preferably 4.8 mgKOH/g or more, and further preferably 5.0 mgKOH/g or more.

The base number thereof is preferably 10.0 mgKOH/g or less, more preferably 8.0 mgKOH/g or less, and further preferably 7.5 mgKOH/g or less, from the standpoint of reducing the friction coefficient of the lubricating oil composition.

In the description herein, the base number (initial base number) of the lubricating oil composition is a value that is measured by the potentiometric titration method (base number-perchloric acid method) according to JIS K2501:2003, Section 8.

<Calcium Atom Content, Magnesium Atom Content, Molybdenum Atom Content, and Phosphorus Atom Content>

The calcium atom content of the lubricating oil composition according to the present embodiment is preferably 0.20% by mass or less, more preferably 0.17% by mass or less, and further preferably 0.15% by mass or less, and is preferably 0.10% by mass or more, more preferably 0.11% by mass or more, and further preferably 0.12% by mass or more, based on the total amount of the lubricating oil composition.

The magnesium atom content of the lubricating oil composition according to the present embodiment is preferably 0.07% by mass or less, more preferably less than 0.07% by mass, further preferably 0.06% by mass or less, still further preferably 0.05% by mass or less, and still more further preferably 0.04% by mass or less, and is preferably 0.01% by mass or more, and more preferably 0.02% by mass or more, based on the total amount of the lubricating oil composition.

The molybdenum atom content of the lubricating oil composition according to the present embodiment is preferably 0.06% by mass or more, and more preferably 0.07% by mass or more, and is preferably 0.15% by mass or less.

The phosphorus atom content of the lubricating oil composition according to the present embodiment is preferably 0.10% by mass or less, more preferably 0.09% by mass or less, and further preferably 0.08% by mass or less, and is preferably 0.02% by mass or more, more preferably 0.04% by mass or more, and further preferably 0.05% by mass or more.

In the description herein, the contents of calcium atoms, magnesium atoms, molybdenum atoms, and phosphorus atoms of the lubricating oil composition are values that are measured according to JIS-5S-38-03.

[Production Method of Lubricating Oil Composition]

The production method of the lubricating oil composition according to the present embodiment is not particularly limited.

For example, the production method of the lubricating oil composition according to the first embodiment may include a step of preparing a lubricating oil composition containing the base oil (A), the metal-based detergent (B) containing the calcium-based detergent (B1) and the magnesium-based detergent (B2), the ash-free friction modifier (C) containing one or more kind selected from the amine-based friction modifier (C1) and the ether-based friction modifier (C2), and the molybdenum compound (D). In this step, in the case where the lubricating oil composition contains the amine-based friction modifier (C1), the content of the amine-based friction modifier (C1) is regulated to more than 0.05% by mass based on the total amount of the lubricating oil composition, the content of molybdenum atoms derived from the molybdenum compound (D) is regulated to 0.05% by mass or more based on the total amount of the lubricating oil composition, the base number measured by the hydrochloric acid method of the lubricating oil composition is regulated to 4.0 mgKOH/g or more, and the HTHS viscosity at 150° C. of the lubricating oil composition is regulated to 1.3 mPa·s or more and less than 2.3 mPa·s.

The production method of the lubricating oil composition according to the second embodiment may include a step of preparing a lubricating oil composition containing the base oil (A), the metal-based detergent (B) containing the calcium-based detergent (B1) and the magnesium-based detergent (B2), and the molybdenum compound (D). The molybdenum compound (D) contains the molybdenum dithiocarbamate (D1) and one or more kind selected from the molybdenum dithiophosphate (D2) and the dialkylamine molybdate (D3). In this step, the content of molybdenum atoms derived from the molybdenum compound (D) is regulated to 0.05% by mass or more based on the total amount of the lubricating oil composition, the base number measured by the hydrochloric acid method of the lubricating oil composition is regulated to 4.0 mgKOH/g or more, and the HTHS viscosity at 150° C. of the lubricating oil composition is regulated to 1.3 mPa·s or more and less than 2.3 mPa·s.

The method of mixing the components is not particularly limited, and examples thereof include a method including a step of blending the components in the base oil (A). At this time, the additional additives for a lubricating oil may also be blended simultaneously. The components each may be blended after forming into a solution (or a dispersion) in advance by adding a diluent oil or the like. After blending, the components are preferably dispersed uniformly by agitating by a known method.

[Application of Lubricating Oil Composition]

The lubricating oil composition according to the present embodiment can regulate the initial base number to the prescribed value or more while reducing the friction coefficient in a wide temperature range including a low temperature range.

Accordingly, the lubricating oil composition according to the present embodiment is used in a gasoline engine, and preferably an automobile engine. The lubricating oil composition is more preferably applied to, in the automobile engine, an automobile engine equipped with a hybrid system or a start-stop system.

Therefore, the lubricating oil composition according to the present embodiment provides the following items (1) to (3).

(1) A use method including using the lubricating oil composition according to the present embodiment in a gasoline engine.

(2) A use method including using the lubricating oil composition according to the present embodiment in an automobile engine.

(3) A use method including using the lubricating oil composition according to the present embodiment in an automobile engine equipped with a hybrid system or an automobile engine equipped with a start-stop system.

Embodiments Provided by Present Invention

Examples of embodiments provided by the present invention include the following [1] to [8].

[1] A lubricating oil composition used in a gasoline engine, containing a base oil (A), a metal-based detergent (B) containing a calcium-based detergent (B1) and a magnesium-based detergent (B2), and a molybdenum compound (D), the molybdenum compound (D) containing a molybdenum dithiocarbamate (D1) and one or more kind selected from a molybdenum dithiophosphate (D2) and a dialkylamine molybdate (D3), the lubricating oil composition having a content of Mo atoms derived from the molybdenum compound (D) of 0.05% by mass or more based on the total amount of the lubricating oil composition, a base number measured by a hydrochloric acid method of 4.0 mgKOH/g or more, and an HTHS viscosity at 150° C. of 1.3 mPa·s or more and less than 2.3 mPa·s.

[2] A lubricating oil composition used in a gasoline engine, containing a base oil (A), a metal-based detergent (B) containing a calcium-based detergent (B1) and a magnesium-based detergent (B2), an ash-free friction modifier (C) containing one or more kind selected from an amine-based friction modifier (C1) and an ether-based friction modifier (C2), and a molybdenum compound (D), the lubricating oil composition having in the case where the lubricating oil composition contains the amine-based friction modifier (C1), a content of the amine-based friction modifier (C1) of more than 0.05% by mass based on the total amount of the lubricating oil composition, a content of Mo atoms derived from the molybdenum compound (D) of 0.05% by mass or more based on the total amount of the lubricating oil composition, a base number measured by a hydrochloric acid method of 4.0 mgKOH/g or more, and an HTHS viscosity at 150° C. of 1.3 mPa·s or more and less than 2.3 mPa·s.

[3] The lubricating oil composition according to the item [2], wherein the lubricating oil composition has a content ratio ((C1)/(C2)) of the amine-based friction modifier (C1) and the ether-based friction modifier (C2) in terms of mass ratio of 0.20 to 1.00.

[4] The lubricating oil composition according to the item [2] or [3], wherein the molybdenum compound (D) contains one or more kind selected from the molybdenum dithiocarbamate (D1), the molybdenum dithiophosphate (D2), and the dialkylamine molybdate (D3).

[5] The lubricating oil composition according to any one of the items [1] to [4], wherein the lubricating oil composition has a content of Ca atoms derived from the calcium-based detergent (B1) of 0.20% by mass or less.

[6] The lubricating oil composition according to any one of the items [1] to [5], wherein the lubricating oil composition has a content of Mg atoms derived from the magnesium-based detergent (B2) of 0.07% by mass or less.

[7] The lubricating oil composition according to any one of the items [1] to [6], wherein the lubricating oil composition has a content ratio ((B1)/(B2)) of the calcium-based detergent (B1) and the magnesium-based detergent (B2) in terms of mass ratio of 1.0 to 10.

[8] The lubricating oil composition according to any one of the items [1] to [7], wherein the calcium-based detergent (B1) contains a calcium salicylate.

EXAMPLES

The present invention will be described specifically with reference to examples below, but the present invention is not limited to the examples.

[Measurement Methods of Property Values]

The properties of the raw materials used in Examples and Comparative Examples and the lubricating oil compositions of Examples and Comparative Examples were measured according to the following procedures.

(1) 100° C. Kinematic Viscosity

The 100° C. kinematic viscosity of the base oil and the 100° C. kinetic viscosity of the lubricating oil composition were measured according to JIS K2283:2000.

(2) HTHS Viscosity at 150° C.

The HTHS viscosity at 150° C. of the lubricating oil composition was measured according to ASTM D4683 with a TBS high temperature viscometer (tapered bearing simulator viscometer) under a temperature condition of 150° C. at a shear velocity of $10^6$/s.

(3) Contents of Atoms

The contents of calcium atoms, magnesium atoms, molybdenum atoms, and phosphorus atoms of the lubricating oil composition were measured according to JIS-5S-38-03.

(4) Base Number

The base numbers of the calcium-based detergent (B1) and the magnesium-based detergent (B2) were measured by the potentiometric titration method (base number-perchloric acid method) according to JIS K2501:2003, Section 9.

The base number (initial base number) of the lubricating oil composition was measured by the potentiometric titration method (base number-perchloric acid method) according to JIS K2501:2003, Section 8.

Examples 1 to 12 and Comparative Examples 1 to 5

The base oil and the additives shown below were sufficiently mixed in the blending amounts (% by mass) shown in Tables 1 and 2, so as to prepare lubricating oil compositions of Examples 1 to 12 and Comparative Examples 1 to 5.

The details of the base oil and the additives used in Examples 1 to 12 and Comparative Examples 1 to 5 are shown below.

<Base Oil (A)>

Mineral oil (100° C. kinematic viscosity: 4.0 $mm^2$/s, API classification: group 3)

<Metal-Based Detergent (B)>

(Calcium-Based Detergent (B1))

Ca salicylate (Ca atom content: 8% by mass, base number: 230 mgKOH/g) (Magnesium-based Detergent (B2))

Mg sulfonate (Mg atom content: 9.5% by mass, base number: 400 mgKOH/g)

<Ash-Free Friction Modifier (C)>

(Amine-Based Friction Modifier (C1))

Oleyldiethanolamine (Ether-Based Friction Modifier (C2))

Polyglycerin Ether (Ester-Based Friction Modifier)

Glycerin Monooleate (GMO)

<Molybdenum Compound (D)>

Molybdenum dithiocarbamate (D1) (MoDTC, molybdenum atom content: 10% by mass)

Molybdenum dithiophosphate (D2) (MoDTP, molybdenum atom content: 8.5% by mass, phosphorus atom content: 5.5% by mass)

Dialkylamine molybdate (D3) (molybdenum atom content: 7.9% by mass)

<Additional Additives for Lubricating Oil>

Succinimide, antioxidant, pour point depressant, ZnDTP, and viscosity index improver Evaluation Methods The evaluation of the effect of reducing the friction coefficient and the evaluation of the reducing rate of the base number by the ISOT test described below were performed.

<Evaluation of Effect of reducing Friction Coefficient>

The prepared lubricating oil composition was measured for the friction coefficient in use under the following condition with an SRV tester (produced by Optimol Instruments Priiftechnik GmbH). An average value of the friction coefficient within a period of 1 minute selected from a period of from after 5 minutes from the start of test to the end of test was calculated.

Cylinder: SUJ-2

Disk: AISI 52100

Vibration frequency: 50 Hz

Amplitude: 1.5 mm

Load: 400 N

Temperature: 30° C., 40° C., or 80° C.

Test period; 30 minutes

The reducing rate (%) of the friction coefficient with respect to Comparative Example 1 was calculated according to the following expression (a) based on the friction coefficient of Comparative Example 1, and a specimen having a value of less than −5 was evaluated as excellent in effect of reducing the friction coefficient. A specimen having a value of −5 to 5 was evaluated as having an effect of reducing the friction coefficient equivalent to Comparative Example 1.

Reducing rate of friction coefficient(%)=(((friction coefficient of target Example or Comparative Example)−(friction coefficient of Comparative Example1))/(friction coefficient of Comparative Example1))×100 (a)

The friction coefficients of Comparative Example 1 were as follows.

Friction coefficient at 30° C.: 0.09

Friction coefficient at 40° C.: 0.09

Friction coefficient at 80° C.: 0.07

<Evaluation of Reducing Rate of Base Number by ISOT Test>

The prepared lubricating oil composition was measured for the base number (initial base number).

Subsequently, a copper piece and an iron piece as a catalyst were placed in the prepared lubricating oil composition, and the prepared lubricating oil composition was forcedly deteriorated by performing the ISOT test according to JIS K2514-1: 2013 at 165.5° C. for 72 hours, so as to provide a deteriorated oil. The deteriorated oil was measured for the base number (base number after deterioration), and the reducing rate of the base number by the ISOT test was calculated according the following expression (1). A specimen having a value of −85 or more was evaluated as securing the base number retaining capability.

Reducing rate of base number by ISOT test(%)=(−((initial base number)−(base number after deterioration))/(initial base number))×100 (1)

TABLE 1

| | | | | Example | | | | | |
|---|---|---|---|---|---|---|---|---|---|
| | | | Unit | 1 | 2 | 3 | 4 | 5 | 6 |
| Lubricating oil composition | Base oil (A) | | % by mass | 89.0 | 89.5 | 89.6 | 89.7 | 89.8 | 89.6 |
| | Metal-based detergent (B) | Calcium-based detergent (B1) | % by mass | 1.80 | 1.80 | 1.80 | 1.80 | 1.80 | 1.80 |
| | | Magnesium-based detergent (B2) | % by mass | 0.80 | 0.30 | 0.20 | 0.30 | 0.30 | 0.30 |
| | Ash-free friction modifier (C) | Amine-based friction modifier (C1) | % by mass | 0.10 | 0.10 | 0.10 | 0.10 | 0.10 | — |
| | | Ether-based friction modifier (C2) | % by mass | 0.30 | 0.30 | 0.30 | 0.15 | — | 0.30 |
| | | Ester-based friction modifier | % by mass | — | — | — | — | — | — |
| | Molybdenum compound (D) | Molybdenum dithiocarbamate (D1) | % by mass | 0.70 | 0.70 | 0.70 | 0.70 | 0.70 | 0.70 |
| | | Molybdenum dithiophosphate (D2) MoDTP (Mo content: 8.5%, P content: 5.5%) | % by mass | — | — | — | — | — | — |
| | | Dialkylamine molybdate (D3) | % by mass | — | — | — | — | — | — |
| | Additional additive for lubricating oil | | % by mass | 7.30 | 7.30 | 7.30 | 7.30 | 7.30 | 7.30 |
| | Total | | % by mass | 100.00 | 100.00 | 100.00 | 100.00 | 100.00 | 100.00 |
| | Calcium-based detergent (B1)/magnesium-based detergent (B2) | | | 2.3 | 6.0 | 9.0 | 6.0 | 6.0 | 6.0 |
| | Amine-based friction modifier (C1)/ether-based friction modifier (C2) | | | 0.33 | 0.33 | 0.33 | 0.67 | — | — |
| | Molybdenum dithiocarbamate (D1)/(molybdenum dithiophosphate (D2) + dialkylamine molybdate (D3)) | | | — | — | — | — | — | — |
| Properties of lubricating oil composition | Ca atoms | | % by mass | 0.14 | 0.14 | 0.14 | 0.14 | 0.14 | 0.14 |
| | Mg atoms | | % by mass | 0.07 | 0.03 | 0.02 | 0.03 | 0.03 | 0.03 |
| | Mo atoms | | % by mass | 0.07 | 0.07 | 0.07 | 0.07 | 0.07 | 0.07 |
| | P atoms | | % by mass | 0.07 | 0.07 | 0.07 | 0.07 | 0.07 | 0.07 |
| | 100° C. kinematic viscosity | | $mm^2/g$ | 5.0 | 4.7 | 4.7 | 4.7 | 4.7 | 4.7 |
| | 150° C. HTHS viscosity | | mPa · s | 1.7 | 1.7 | 1.7 | 1.7 | 1.7 | 1.7 |
| | Base number (hydrochloric acid method) | | mgKOH/g | 7.1 | 5.6 | 5.2 | 5.6 | 5.6 | 5.5 |
| Evaluation result | Reducing rate of friction coefficient from standard oil (%) | | 30° C. | −9 | −7 | −10 | −15 | −10 | −8 |
| | | | 40° C. | −13 | −5 | −7 | −13 | −7 | −8 |
| | | | 80° C. | −2 | 2 | 0 | 5 | 4 | 3 |
| | Reducing rate of base number (hydrochloric acid method) by ISOT test (165.5° C., 72 hr) | | % | −75 | −80 | −81 | — | — | — |

TABLE 1-continued

| | | | Unit | Example 7 | 8 | 9 | 10 | 11 | 12 |
|---|---|---|---|---|---|---|---|---|---|
| Lubricating oil composition | Base oil (A) | | % by mass | 89.4 | 89.4 | 89.3 | 89.5 | 89.9 | 89.8 |
| | Metal-based detergent (B) | Calcium-based detergent (B1) | % by mass | 1.80 | 1.80 | 1.80 | 1.80 | 1.80 | 1.80 |
| | | Magnesium-based detergent (B2) | % by mass | 0.30 | 0.30 | 0.30 | 0.30 | 0.30 | 0.30 |
| | Ash-free friction modifier (C) | Amine-based friction modifier (C1) | % by mass | 0.10 | 0.10 | 0.10 | 0.10 | — | — |
| | | Ether-based friction modifier (C2) | % by mass | 0.30 | 0.30 | 0.30 | 0.30 | — | — |
| | | Ester-based friction modifier | % by mass | — | — | — | — | — | — |
| | Molybdenum compound (D) | Molybdenum dithiocarbamate (D1) | % by mass | 0.80 | 0.70 | 0.70 | 0.50 | 0.50 | 0.70 |
| | | Molybdenum dithiophosphate (D2) MoDTP (Mo content: 8.5%, P content: 5.5%) | % by mass | — | — | 0.20 | 0.20 | 0.20 | — |
| | | Dialkylamine molybdate (D3) | % by mass | — | 0.13 | — | — | — | 0.13 |
| | Additional additive for lubricating oil | | % by mass | 7.30 | 7.30 | 7.30 | 7.30 | 7.30 | 7.30 |
| | Total | | % by mass | 100.00 | 100.00 | 100.00 | 100.00 | 100.00 | 100.00 |
| | Calcium-based detergent (B1)/magnesium-based detergent (B2) | | | 6.0 | 6.0 | 6.0 | 6.0 | 6.0 | 6.0 |
| | Amine-based friction modifier (C1)/ether-based friction modifier (C2) | | | 0.33 | 0.33 | 0.33 | 0.33 | — | — |
| | Molybdenum dithiocarbamate (D1)/ (molybdenum dithiophosphate (D2) + dialkylamine molybdate (D3)) | | | — | 5.4 | 3.5 | 2.5 | 2.5 | 5.4 |
| Properties of lubricating oil composition | Ca atoms | | % by mass | 0.14 | 0.14 | 0.14 | 0.14 | 0.14 | 0.14 |
| | Mg atoms | | % by mass | 0.03 | 0.03 | 0.03 | 0.03 | 0.03 | 0.03 |
| | Mo atoms | | % by mass | 0.08 | 0.08 | 0.09 | 0.07 | 0.07 | 0.08 |
| | P atoms | | % by mass | 0.07 | 0.07 | 0.08 | 0.08 | 0.08 | 0.07 |
| | 100° C. kinematic viscosity | | $mm^2/g$ | 4.8 | 4.8 | 4.9 | 4.6 | 4.7 | 4.8 |
| | 150° C. HTHS viscosity | | mPa · s | 1.7 | 1.7 | 1.7 | 1.7 | 1.7 | 1.7 |
| | Base number (hydrochloric acid method) | | mgKOH/g | 5.6 | 5.6 | 5.6 | 5.6 | 5.5 | 5.6 |
| Evaluation result | Reducing rate of friction coefficient from standard oil (%) | | 30° C. | −12 | −11 | −11 | −31 | −7 | −25 |
| | | | 40° C. | −17 | −7 | −13 | −27 | −12 | −27 |
| | | | 80° C. | −11 | −13 | −1 | −10 | −5 | −17 |
| | Reducing rate of base number (hydrochloric acid method) by ISOT test (165.5° C., 72 hr) | | % | — | — | — | — | — | — |

TABLE 2

| | | | Unit | Comparative Example 1 | 2 | 3 | 4 | 5 |
|---|---|---|---|---|---|---|---|---|
| Lubricating oil composition | Base oil (A) | | % by mass | 88.9 | 89.8 | 89.6 | 89.8 | 90.2 |
| | Metal-based detergent (B) | Calcium-based detergent (B1) | % by mass | 1.80 | 1.80 | 1.80 | 1.80 | 1.80 |
| | | Magnesium-based detergent (B2) | % by mass | 0.80 | — | 0.30 | 0.30 | 0.30 |
| | Ash-free friction modifier (C) | Amine-based friction modifier (C1) | % by mass | — | 0.10 | 0.05 | 0.10 | 0.10 |
| | | Ether-based friction modifier (C2) | % by mass | — | 0.30 | 0.30 | 0.30 | 0.30 |
| | | Ester-based friction modifier | % by mass | 0.50 | — | — | — | — |
| | Molybdenum compound (D) | Molybdenum dithiocarbamate (D1) | % by mass | 0.70 | 0.70 | 0.70 | 0.40 | — |
| | | Molybdenum dithiophosphate (D2) MoDTP (Mo content: 8.5%, P content: 5.5%) | % by mass | — | — | — | — | — |
| | | Dialkylamine molybdate (D3) | % by mass | — | — | — | — | — |
| | Additional additive for lubricating oil | | % by mass | 7.30 | 7.30 | 7.30 | 7.30 | 7.30 |
| | Total | | % by mass | 100.00 | 100.00 | 100.00 | 100.00 | 100.00 |
| | Calcium-based detergent (B1)/magnesium-based detergent (B2) | | | 2.3 | — | 6.0 | 6.0 | 6.0 |
| | Amine-based friction modifier (C1)/ether-based friction modifier (C2) | | | — | 0.33 | 0.17 | 0.33 | 0.33 |
| | Molybdenum dithiocarbamate (D1)/ (molybdenum dithiophosphate (D2) + dialkylamine molybdate (D3)) | | | — | — | — | — | — |
| Properties of lubricating oil composition | Ca atoms | | % by mass | 0.14 | 0.14 | 0.14 | 0.14 | 0.14 |
| | Mg atoms | | % by mass | 0.07 | 0.00 | 0.03 | 0.03 | 0.03 |
| | Mo atoms | | % by mass | 0.07 | 0.07 | 0.07 | 0.04 | 0.00 |
| | P atoms | | % by mass | 0.07 | 0.07 | 0.07 | 0.07 | 0.07 |
| | 100° C. kinematic viscosity | | $mm^2/g$ | 4.8 | 4.7 | 4.7 | 4.7 | 4.7 |
| | 150° C. HTHS viscosity | | mPa · s | 1.7 | 1.7 | 1.7 | 1.7 | 1.7 |
| | Base number (hydrochloric acid method) | | mgKOH/g | 7.0 | 4.5 | 5.6 | 5.6 | 5.6 |
| Evaluation result | Reducing rate of friction coefficient from standard oil (%) | | 30° C. | 0 | −13 | −1 | 15 | 77 |
| | | | 40° C. | 0 | −14 | −1 | 20 | 81 |
| | | | 80° C. | 0 | −6 | 3 | −10 | 133 |
| | Reducing rate of base number (hydrochloric acid method) by ISOT test (165.5° C., 72 hr) | | % | −74 | −87 | — | — | — |

The following matters are understood from Tables 1 and 2.

It is understood that the lubricating oil compositions of Examples 1 to 12 have low friction coefficients at 30° C. and 40° C., secure a low value for the friction coefficient at 80° C., and secure the prescribed initial base number. The lubricating oil compositions of Examples 1 to 3 are excellent in base number retaining capability.

On the other hand, it is understood that the lubricating oil composition that does not contain both the amine-based friction modifier (C1) and the ether-based friction modifier (C2) as in Comparative Example 1 has high friction coefficients at 30° C. and 40° C., failing to provide the effect of reducing the friction coefficient in a low temperature range.

It is understood that the case where the magnesium-based detergent (B2) is not contained as in Comparative Example 2 is inferior in base number retention rate, failing to secure the base number retaining capability.

It is understood that the case where the content of the amine-based friction modifier (C1) is 0.05% by mass or less based on the total amount of the lubricating oil composition as in Comparative Example 3 has high friction coefficients at 30° C. and 40° C., failing to provide the effect of reducing the friction coefficient in a low temperature range.

It is understood that the case where the content of molybdenum atoms derived from the molybdenum compound (D) is less than 0.05% by mass as in Comparative Example 4 has high friction coefficients at 30° C. and 40° C., failing to provide the effect of reducing the friction coefficient in a low temperature range.

It is understood that the case where the molybdenum compound (D) is not contained as in Comparative Example 5 has high friction coefficients at 30° C., 40° C., and 80° C., failing to provide the effect of reducing the friction coefficient.

The invention claimed is:

1. A lubricating oil composition, comprising:

a base oil (A);

a metal-based detergent (B) comprising a calcium-based detergent (B1) and a magnesium-based detergent (B2); and a molybdenum compound (D) comprising a molybdenum dithiocarbamate (D1), and a molybdenum dithiophosphate (D2) and/or a dialkylamine molybdate (D3), wherein a content of one or more selected from base oils classified into Groups 2 and 3 in the base oil category of the American Petroleum Institute (API) is 85% by mass or more, based on total lubricating oil composition mass, wherein the lubricating oil composition has a content of Mo atoms derived from the molybdenum compound (D) of 0.05% by mass or more, based on total lubricating oil composition mass, wherein the lubricating oil composition has a base number measured by a hydrochloric acid method of 4.0 mg KOH/g or more, and wherein the lubricating oil composition has an HTHS viscosity at 150° C. in a range of from 1.3 to less than 2.3 mPa·s.

2. A lubricating oil composition, comprising:

a base oil (A);

a metal-based detergent (B) comprising a calcium-based detergent (B1) and a magnesium-based detergent (B2);

an ash-free friction modifier (C) comprising an amine-based friction modifier (C1) and an ether-based friction modifier (C2); and a molybdenum compound (D), wherein a content of one or more selected from base oils classified into Groups 2 and 3 in the base oil category of the American Petroleum Institute (API) is 85% by mass or more, based on total lubricating oil composition mass, wherein, if the lubricating oil composition comprises the amine-based friction modifier (C1), the lubricating oil composition has a content of the amine-based friction modifier (C1) of more than 0.05% by mass, based on total lubricating oil composition mass, wherein the lubricating oil composition has a content of Mo atoms derived from the molybdenum compound (D) of 0.05% by mass or more based on the total lubricating oil composition mass, wherein the lubricating oil composition has a base number measured by a hydrochloric acid method of 4.0 mg KOH/g or more, wherein the lubricating oil composition has a (C1)/(C2) mass content ratio of the amine-based friction modifier (C1) to the ether-based friction modifier (C2) in a range of from 0.20 to 1.00, and wherein the lubricating oil composition has an HTHS viscosity at 150° C. in a range of from 1.3 to less than 2.3 mPa·s.

3. The composition of claim 2, wherein the molybdenum compound (D) comprises a molybdenum dithiocarbamate (D1), a molybdenum dithiophosphate (D2), and/or a dialkylamine molybdate (D3).

4. The composition of claim 1, having a content of Ca atoms derived from the calcium-based detergent (B1) of 0.20% by mass or less.

5. The composition of claim 1, having a content of Mg atoms derived from the magnesium-based detergent (B2) of 0.07% by mass or less.

6. The composition of claim 1, having a (B1)/(B2) mass content ratio of the calcium-based detergent (B1) to the magnesium-based detergent (B2) in a range of from 1.0 to 10.

7. The composition of claim 1, wherein the calcium-based detergent (B1) comprises a calcium salicylate.

8. The composition of claim 1, wherein the molybdenum dithiocarbamate (D1) is a binuclear molybdenum dithiocarbamate.

9. The composition of claim 1, comprising the dialkylamine molybdate (D3).

10. The composition of claim 1, comprising the molybdenum dithiocarbamate (D1) and the dialkylamine molybdate (D3).

11. The composition of claim 1, comprising the base oil (A) in a range of from 85 to 95% by mass, based on the total lubricating oil composition mass.

12. The composition of claim 1, comprising by mass percentage, relative to the total lubricating oil composition mass:

the base oil (A) in a range of from 85 to 93%.

13. The composition of claim 12, comprising the base oil (A) in a range of from 85 to 92% by mass.

14. The composition of claim 1, consisting of:

the base oil (A);

the metal-based detergent (B);

the molybdenum compound (D);

additives in up to 7.3% mass; and optionally, an ash-free friction modifier (C) comprising an amine-based friction modifier (C1) and/or an ether-based friction modifier (C2).

15. The composition of claim 2, wherein, by mass percentage, relative to the total lubricating oil composition mass:

the base oil (A) is present in a range of from 85 to 93%;

calcium atoms derived from the calcium-based detergent (B1) are present in 0.20% or less;

magnesium atoms derived from the magnesium-based detergent (B2) are present in 0.07% or less;

the amine-based friction modifier (C1) is present in a range of from 0.06 to 0.30% and the ether-based friction modifier (C2) is present in a range of from 0.10 to 0.50%; and the molybdenum compound (D), calculated as molybdenum atoms, is present in a range of from 0.05 to 0.20%, wherein a (C1)/(C2) mass content ratio of the amine-based friction modifier (C1) to the ether-based friction modifier (C2) is in a range of from 0.20 to 1.00, wherein a total (C1) and (C2) content of the amine-based friction modifier (C1) and the ether-based friction modifier (C2) is in a range of from 0.10 to 0.60%, and wherein a total (B1) and (B2) content of the calcium-based detergent (B1) and the magnesium-based detergent (B2) is in a range of from 80 to 100%, based on total the metal-based detergent (B) mass.

16. The composition of claim 15, wherein:

the base oil (A) is present in a range of from 85 to 92% by mass;

the calcium atoms derived from the calcium-based detergent (B1) are present in a range of from 0.10 to 0.20%;

the magnesium atoms derived from the magnesium-based detergent (B2) are present in a range of from 0.01 to 0.06%;

the amine-based friction modifier (C1) is present in a range of from 0.08 to 0.20% and the ether-based friction modifier (C2) in a range of from 0.12 to 0.40%;

the molybdenum compound (D), calculated as molybdenum atoms, is present in a range of from 0.06 to 0.15%;

wherein the (C1)/(C2) mass content ratio is in a range of from 0.25 to 0.80, wherein the total (C1) and (C2) content is in a range of from 0.15 to 0.55%, and wherein the total (B1) and (B2) content is in a range of from 90 to 100%.

17. The composition of claim 15, wherein:

the base oil (A) is present in a range of from 85 to 92% by mass;

the calcium atoms derived from the calcium-based detergent (B1) are present in a range of from 0.11 to 0.17%;

the magnesium atoms derived from the magnesium-based detergent (B2) are present in a range of from 0.02 to 0.05%;

the amine-based friction modifier (C1) is present in a range of from 0.09 to 0.20% and the ether-based friction modifier (C2) is present in a range of from 0.14 to 0.40%;

the molybdenum compound (D), calculated as molybdenum atoms, is present in a range of from 0.07 to 0.10% by mass;

wherein the (C1)/(C2) mass content ratio is in a range of from 0.25 to 0.75, wherein the total (C1) and (C2) content is in a range of from 0.20 to 0.50%, and wherein the total (B1) and (B2) content is in a range of from 95 to 100%.

18. The composition of claim 17, wherein:

the calcium atoms derived from the calcium-based detergent (B1) is present in a range of from 0.12 to 0.15%;

magnesium atoms derived from the magnesium-based detergent (B2) is present in a range of from 0.02 to 0.04%;

the magnesium-based detergent (B2) is present in 0.04% or less;

the amine-based friction modifier (C1) is present in a range of from 0.10 to 0.20% and the ether-based friction modifier (C2) is present in a range of from 0.14 to 0.40%; and wherein the (C1)/(C2) mass content ratio is in a range of from 0.30 to 0.70.

19. The composition of claim 18, comprising the amine-based friction modifier (C1) in a range of from 0.10 to 0.20% and the ether-based friction modifier (C2) in a range of from 0.14 to 0.40%, wherein a (B1)/(B2) mass content ratio of the calcium-based detergent (B1) and the magnesium-based detergent (B2) is in a range of from 4.0 to 8.0, and wherein a (D1)/(D2+D3) mass ratio of a molybdenum dithiocarbamate (D1) and a molybdenum dithiophosphate (D2) and/or a dialkylamine molybdate (D3) is in a range of from 1.0 to 6.0.

20. The composition of claim 2, comprising by mass percentage, relative to the total lubricating oil composition mass:

the ether-based friction modifier (C2) in a range of from 0.10 to 0.50%.

* * * * *